US010247441B2

(12) United States Patent
Suzuki et al.

(10) Patent No.: US 10,247,441 B2
(45) Date of Patent: Apr. 2, 2019

(54) REFRIGERATION CYCLE APPARATUS WITH LEAK DETECTION AND ASSOCIATED AIR FLOW CONTROL

(71) Applicant: Mitsubishi Electric Corporation, Tokyo (JP)

(72) Inventors: Yasuhiro Suzuki, Tokyo (JP); Takaaki Takishita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/511,812

(22) PCT Filed: Nov. 25, 2014

(86) PCT No.: PCT/JP2014/081075
§ 371 (c)(1),
(2) Date: Mar. 16, 2017

(87) PCT Pub. No.: WO2016/084128
PCT Pub. Date: Jun. 2, 2016

(65) Prior Publication Data
US 2017/0292744 A1 Oct. 12, 2017

(51) Int. Cl.
*F24F 11/00* (2018.01)
*F24F 11/89* (2018.01)
(Continued)

(52) U.S. Cl.
CPC ..... *F24F 11/89* (2018.01); *F24F 11/36* (2018.01); *F24F 11/74* (2018.01); *F24F 13/15* (2013.01);
(Continued)

(58) Field of Classification Search
CPC . F24F 11/36; F25B 2500/22; F25B 2500/222; F25B 2600/11; F25B 2600/111; F25B 2600/112
See application file for complete search history.

(56) References Cited

U.S. PATENT DOCUMENTS 6,692,349 B1 * 2/2004 Brinkerhoff ..... F24F 7/00 454/256
7,670,414 B2 * 3/2010 Cha ..... B01D 46/12 55/418
(Continued)

FOREIGN PATENT DOCUMENTS

CN 1147077 A 4/1997
CN 1342874 A 4/2002
(Continued)

OTHER PUBLICATIONS

International Search Report of the International Searching Authority dated Feb. 24, 2015 for the corresponding International application No. PCT/JP2014/081075 (and English translation).
(Continued)

*Primary Examiner* — Jonathan Bradford
(74) *Attorney, Agent, or Firm* — Posz Law Group, PLC

(57) ABSTRACT

A refrigeration cycle apparatus includes a refrigeration cycle through which refrigerant is circulated, an indoor unit that accommodates at least a load-side heat exchanger of the refrigeration cycle and is placed indoors, and a controller that controls the indoor unit. The indoor unit includes an indoor air-blowing fan, an air inlet through which indoor air is sucked in, and an air outlet through which the air sucked in from the air inlet is blown indoors. The controller activates the indoor air-blowing fan when leakage of refrigerant is detected. An air passage that allows air to pass
(Continued)

through the air outlet is established in the air outlet at least when leakage of refrigerant is detected.

4 Claims, 18 Drawing Sheets

(51) Int. Cl.

| | |
|---|---|
| ***F24F 11/74*** | (2018.01) |
| ***F24F 11/36*** | (2018.01) |
| ***F24F 13/15*** | (2006.01) |
| ***F25B 49/02*** | (2006.01) |
| ***F25B 13/00*** | (2006.01) |

(52) U.S. Cl.
CPC ..... *F25B 13/00* (2013.01); *F25B 49/02* (2013.01); *F25B 2313/0293* (2013.01); *F25B 2400/12* (2013.01); *F25B 2500/222* (2013.01)

(56) References Cited

U.S. PATENT DOCUMENTS

| | | | | |
|---|---|---|---|---|
| 2002/0178738 | A1* | 12/2002 | Taira | F25B 49/005 62/129 |
| 2013/0098576 | A1 | 4/2013 | Fujitaka et al. | |
| 2017/0350614 | A1* | 12/2017 | Nagaoka | F24F 11/0079 |

FOREIGN PATENT DOCUMENTS

| | | | |
|---|---|---|---|
| CN | 102971596 | A | 3/2013 |
| EP | 1326054 | A1 | 7/2003 |
| JP | S57-73539 | U | 5/1982 |
| JP | H08-200904 | A | 8/1996 |
| JP | H09-042755 | A | 2/1997 |
| JP | H10-311629 | A | 11/1998 |
| JP | H11-37619 | A | 2/1999 |
| JP | 2002-372317 | A | 12/2002 |
| JP | 2005-009857 | A | 1/2005 |
| JP | 2008-040652 | A | 2/2008 |
| JP | 2008-175431 | A | 7/2008 |
| JP | 2010-065877 | A | 3/2010 |
| JP | 4599699 | B2 | 10/2010 |
| JP | 2012-013348 | A | 1/2012 |
| JP | 2013-011414 | A | 1/2013 |
| JP | 2014-035171 | A | 2/2014 |

OTHER PUBLICATIONS

Office Action dated Nov. 7, 2017 issued in the corresponding Japanese Patent Application No. 2016-561110 (and English translation).
Office action dated Mar. 22, 2018 issued in corresponding Australian patent application No. 2014412283.
Office Action dated Dec. 5, 2018 issued in corresponding CN patent application No. 201480083560.6 (and English translation).
Extended European Search Report dated Nov. 30, 2018 issued in corresponding EP patent application No. 14906771.2.

* cited by examiner

REFRIGERATION CYCLE APPARATUS WITH LEAK DETECTION AND ASSOCIATED AIR FLOW CONTROL

CROSS REFERENCE TO RELATED APPLICATION

This application is a U.S. national stage application of PCT/JP2014/081075 filed on Nov. 25, 2014, the contents of which are incorporated herein by reference.

TECHNICAL FIELD

The present invention relates to a refrigeration cycle apparatus.

BACKGROUND ART

Patent Literature 1 discloses an air-conditioning apparatus. The air-conditioning apparatus includes a refrigerant detection unit disposed on the outer surface of an indoor unit to detect refrigerant, and a controller that causes an indoor air-blowing fan to rotate when the refrigerant detection unit detects refrigerant. In the air-conditioning apparatus, in situations such as when flammable refrigerant leaks into the indoor space from an extension pipe leading to the indoor unit, and when flammable refrigerant that has leaked out inside the indoor unit flows to the outside of the indoor unit through a gap in the housing of the indoor unit, the leaked refrigerant can be detected by the refrigerant detection unit. Further, when a refrigerant leak is detected, the indoor-unit air-blowing fan is rotated. As a result, the indoor air is sucked in through the air inlet provided in the housing of the indoor unit, and air is blown into the indoor space through the air outlet, thus allowing the leaked refrigerant to be dispersed.

CITATION LIST

Patent Literature

Patent Literature 1: Japanese Patent No. 4599699

SUMMARY OF INVENTION

Technical Problem

However, in Patent Literature 1, there is no mention on the state of the air outlet provided in the indoor unit. Accordingly, for example, depending on the orientation of air flow deflection louvers that are disposed at the air outlet to adjust the direction of flow of the conditioned air, the air outlet may become closed, or even if the air outlet does not become closed, the opening area of the air outlet becomes extremely small. In this case, even if the indoor air-blowing fan is rotated upon detection of a refrigerant leak, ample airflow may not be provided through the air outlet. This may make it impossible to effectively disperse the leaked refrigerant. This can lead to local increases in indoor refrigerant concentration.

The present invention has been made to address the above-mentioned problem, and accordingly it is an object of the invention to provide a refrigeration cycle apparatus that makes it possible to reduce the occurrence of locally increased refrigerant concentrations in the indoor space in the event of a refrigerant leak.

Solution to Problem

A refrigeration cycle apparatus of one embodiment of the present invention is a refrigeration cycle apparatus including a refrigeration cycle through which refrigerant is circulated, an indoor unit that accommodates at least a load-side heat exchanger of the refrigeration cycle, the indoor unit being placed indoors, and a controller that controls the indoor unit. The indoor unit includes an air-blowing fan, an air inlet through which indoor air is sucked in, and an air outlet through which the air sucked in from the air inlet is blown indoors. The controller activates the air-blowing fan when leakage of the refrigerant is detected. An air passage that allows air to pass through the air outlet is established in the air outlet at least when leakage of the refrigerant is detected.

Advantageous Effects of Invention

According to one embodiment of the present invention, in the event that refrigerant leaks out, the leaked refrigerant can be effectively dispersed, thus reducing the occurrence of locally increased refrigerant concentrations in the indoor space.

DESCRIPTION OF EMBODIMENTS

Embodiment 1

Figure 1:
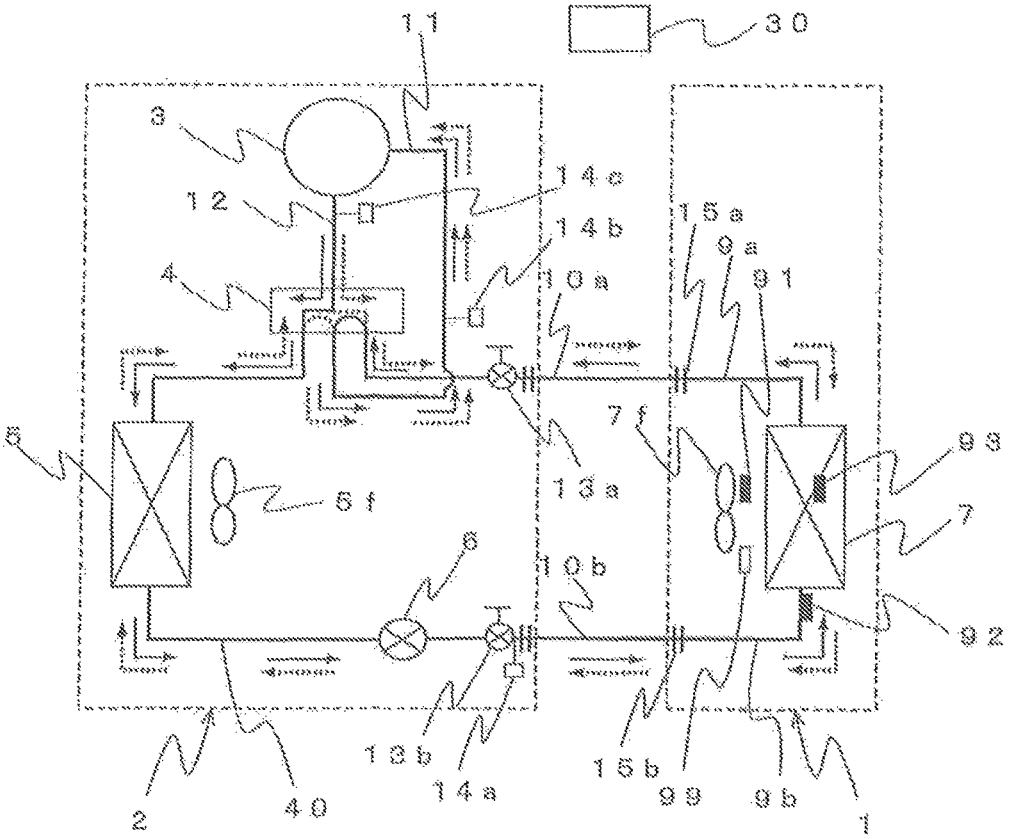
FIG. 1 is a refrigerant circuit diagram illustrating the general configuration of a refrigeration cycle apparatus according to Embodiment 1 of the present invention.

A refrigeration cycle apparatus according to Embodiment 1 of the present invention will be described. FIG. 1 is a refrigerant circuit diagram illustrating the general configuration of a refrigeration cycle apparatus according to Embodiment 1. Embodiment 1 describes an air-conditioning apparatus as an example of a refrigeration cycle apparatus. In the drawings including FIG. 1, features such as the relative sizes of components and their shapes may not be to scale. As a general rule, the relative positions of components (for example, their relative vertical arrangement) in the following description will be based on those when the indoor unit 1 is placed in a usable condition.

As illustrated in FIG. 1, the air-conditioning apparatus has a refrigeration cycle 40 through which refrigerant is circulated. The refrigeration cycle 40 includes the following components connected in a loop via refrigerant pipes in the order stated below: a compressor 3, a refrigerant flow switching device 4, a heat source-side heat exchanger 5 (for example, an outdoor heat exchanger), a pressure reducing device 6, and a load-side heat exchanger 7 (for example, an indoor heat exchanger). The air-conditioning apparatus further includes, for example, an indoor unit 1 (an example of a load unit) that is placed indoors, and an outdoor unit 2 (an example of a heat source unit) that is placed outdoors. The indoor unit 1 and the outdoor unit 2 are connected to each other by extension pipes 10*a* and 10*b* each constituting a part of a refrigerant pipe.

Examples of refrigerant circulated through the refrigeration cycle 40 include a mildly flammable refrigerant such as R-32, HFO-1234yf, or HFO-1234ze, and a highly flammable refrigerant such as R-290 or R-1270. Each of these refrigerants may be used as a single-component refrigerant, or may be used as a refrigerant mixture that is a mixture of two or more types of refrigerant. Hereinafter, refrigerants with levels of flammability equal to or higher than mild flammability (for example, "2L" or higher according to the ASHRAE-34 classification) will be sometimes referred to as "flammable refrigerants". A non-flammable refrigerant that has non-flammability (for example, "1" according to the ASHRAE-34 classification), such as R22 or R410A, may be also used as the refrigerant to be circulated through the refrigeration cycle 40. These refrigerants have densities greater than that of air under atmospheric pressures (for example, at a room temperature (25 degrees C.)).

The compressor 3 is a piece of fluid machinery that compresses a low-pressure refrigerant sucked into the compressor 3, and discharges the compressed refrigerant as a high-pressure refrigerant. The refrigerant flow switching device 4 switches the directions of refrigerant flow within the refrigeration cycle 40 between when in cooling operation and when in heating operation. The refrigerant flow switching device 4 used is, for example, a four-way valve. The heat source-side heat exchanger 5 is a heat exchanger that acts as a radiator (for example, a condenser) in cooling operation, and acts as an evaporator in heating operation. In the heat source-side heat exchanger 5, heat is exchanged between the refrigerant being circulated in the heat source-side heat exchanger 5, and the air (outside air) being sent by an outdoor air-blowing fan 5*f* described later. The pressure reducing device 6 reduces the pressure of a high-pressure refrigerant to turn the refrigerant into a low-pressure refrigerant. The pressure reducing device 6 used is, for example, an electronic expansion valve with an adjustable opening degree. The load-side heat exchanger 7 is a heat exchanger that acts as an evaporator in cooling operation, and acts as a radiator (for example, a condenser) in heating operation. In the load-side heat exchanger 7, heat is exchanged between the refrigerant being circulated in the load-side heat exchanger 7, and the air being sent by an indoor air-blowing fan 7*f* described later. The term cooling operation refers to the operation of supplying a low-temperature, low-pressure refrigerant to the load-side heat exchanger 7, and heating operation refers to the operation of supplying a high-temperature, high-pressure refrigerant to the load-side heat exchanger 7.

The compressor 3, the refrigerant flow switching device 4, the heat source-side heat exchanger 5, and the pressure reducing device 6 are accommodated in the outdoor unit 2. The outdoor air-blowing fan 5*f* for supplying outside air to the heat source-side heat exchanger 5 is also accommodated in the outdoor unit 2. The outdoor air-blowing fan 5*f* is placed facing the heat source-side heat exchanger 5. Rotating the outdoor air-blowing fan 5*f* creates a flow of air that passes through the heat source-side heat exchanger 5. The outdoor air-blowing fan 5*f* used is, for example, a propeller fan. The outdoor air-blowing fan 5*f* is disposed downstream of the heat source-side heat exchanger 5, for example, with respect to the flow of air created by the outdoor air-blowing fan 5*f*.

Refrigerant pipes disposed in the outdoor unit 2 include a refrigerant pipe that connects an extension-pipe connection valve 13*a* located on the gas side (when in cooling operation) with the refrigerant flow switching device 4, a suction pipe 11 connected to the suction side of the compressor 3, a discharge pipe 12 connected to the discharge side of the compressor 3, a refrigerant pipe that connects the refrigerant flow switching device 4 with the heat source-side heat exchanger 5, a refrigerant pipe that connects the heat source-side heat exchanger 5 with the pressure reducing device 6, and a refrigerant pipe that connects the pressure reducing device 6 with an extension-pipe connection valve 13*b* located on the liquid side (when in cooling operation). The extension-pipe connection valve 13*a* is formed by a two-way valve capable of being switched open and close, with a flare coupling attached at its one end. The extension-pipe connection valve 13*b* is formed by a three-way valve capable of being switched open and close. A service port 14*a*, which is used during vacuuming (during an operation performed prior to filling the refrigeration cycle 40 with refrigerant), is attached at one end of the extension-pipe connection valve 13*b*, and a flare coupling is attached at the other end.

A high-temperature, high-pressure gas refrigerant compressed by the compressor 3 flows through the discharge pipe 12 during both cooling operation and heating operation. A low-temperature, low-pressure refrigerant (gas refrigerant or two-phase refrigerant) that has undergone evaporation flows through the suction pipe 11 during both cooling operation and heating operation. The suction pipe 11 is connected with a service port 14*b* with flare coupling, which is located on the low-pressure side, and the discharge pipe 12 is connected with a service port 14*c* with flare coupling, which is located on the high-pressure side. The service ports 14*b* and 14*c* are used to connect a pressure gauge to measure operating pressure during a test run made at the time of installation or repair of the air-conditioning apparatus.

The load-side heat exchanger 7 is accommodated in the indoor unit 1. The indoor air-blowing fan 7*f* for supplying air to the load-side heat exchanger 7 is also placed in the indoor unit 1. Rotating the indoor air-blowing fan 7*f* creates a flow of air that passes through the load-side heat exchanger 7. Depending on the type of the indoor unit 1, examples of the indoor air-blowing fan 7*f* used include a centrifugal fan (for example, a sirocco fan or a turbo fan), a cross-flow fan, a mixed flow fan, and an axial flow fan (for example, a propeller fan). Although the indoor air-blowing fan 7*f* in the present example is disposed upstream of the load-side heat exchanger 7 with respect to the flow of air created by the indoor air-blowing fan 7*f*, the indoor air-blowing fan 7*f* may be disposed downstream of the load-side heat exchanger 7.

Among the refrigerant pipes of the indoor unit 1, the indoor pipe 9*a* on the gas side has a coupling 15*a* (for example, a flare coupling) provided at its connection with the extension pipe 10*a*, which is located on the gas side, to connect the extension pipe 10*a*. Further, among the refrigerant pipes of the indoor unit 1, the indoor pipe 9*b* on the liquid side has a coupling 15*b* (for example, a flare coupling) provided at its connection with the extension pipe 10*b*, which is located on the liquid side, to connect the extension pipe 10*b*.

The indoor unit 1 is further provided with components such as a suction air temperature sensor 91 that detects the temperature of indoor air sucked in from the indoor space, a heat exchanger inlet temperature sensor 92 that detects the temperature of refrigerant at the location of the load-side heat exchanger 7 that becomes the inlet during cooling operation (the outlet during heating operation), and a heat exchanger temperature sensor 93 that detects the temperature (evaporating temperature or condensing temperature) of the two-phase portion of refrigerant in the load-side heat exchanger 7. Further, the indoor unit 1 is provided with a refrigerant detection unit 99 described later. These various sensors each output a detection signal to the controller 30 that controls the indoor unit 1 or the entire air-conditioning apparatus.

The controller 30 has a microcomputer including components such as a CPU, a ROM, a RAM, and an I/O port. The controller 30 is capable of communicating data with an operating unit 26 described later. The controller 30 in the present example controls either the operation of the indoor unit 1 including the operation of the indoor air-blowing fan 7*f*, or the entire air-conditioning apparatus, based on signals such as an operational signal from the operating unit 26 and detection signals from various sensors. The controller 30 may be provided inside the housing of the indoor unit 1, or may be provided inside the housing of the outdoor unit 2. Alternatively, the controller 30 may include an outdoor-unit controller provided in the outdoor unit 2, and an indoor-unit controller that is provided in the indoor unit 1 and capable of communicating data with the outdoor-unit controller.

Next, operation of the refrigeration cycle 40 of the air-conditioning apparatus will be described. First, cooling operation will be described. In FIG. 1, solid arrows indicate the flow of refrigerant in cooling operation. In cooling operation, the refrigerant circuit is configured such that the flow path of refrigerant is switched by the refrigerant flow switching device 4 as indicated by the solid arrows, causing a low-temperature, low-pressure refrigerant to flow to the load-side heat exchanger 7.

A high-temperature, high-pressure gas refrigerant discharged from the compressor 3 first enters the heat source-side heat exchanger 5 via the refrigerant flow switching device 4. In cooling operation, the heat source-side heat exchanger 5 acts as a condenser. That is, in the heat source-side heat exchanger 5, heat is exchanged between the refrigerant being circulated in the heat source-side heat exchanger 5, and the air (outside air) being sent by the outdoor air-blowing fan 5*f*, and the condensation heat of the refrigerant is rejected to the air being sent. This causes the refrigerant entering the heat source-side heat exchanger 5 to condense into a high-pressure liquid refrigerant. The high-pressure liquid refrigerant enters the pressure reducing device 6 where its pressure is reduced, causing the refrigerant to turn into a low-pressure, two-phase refrigerant. The low-pressure, two-phase refrigerant enters the load-side heat exchanger 7 of the indoor unit 1 via the extension pipe 10*b*. In cooling operation, the load-side heat exchanger 7 acts as an evaporator. That is, in the load-side heat exchanger 7, heat is exchanged between the refrigerant being circulated in the load-side heat exchanger 7, and the air (indoor air) being sent by the indoor air-blowing fan 7*f*, and the evaporation heat of the refrigerant is removed from the air being sent. This causes the refrigerant entering the load-side heat exchanger 7 to evaporate into a low-pressure gas refrigerant or two-phase refrigerant. The air sent by the indoor air-blowing fan 7*f* is cooled as the refrigerant removes heat. The low-pressure gas refrigerant or two-phase refrigerant evaporated in the load-side heat exchanger 7 is sucked into the compressor 3 via the extension pipe 10*a* and the refrigerant flow switching device 4. The refrigerant sucked into the compressor 3 is compressed into a high-temperature, high-pressure gas refrigerant. The above cycle is repeated in cooling operation.

Next, heating operation will be described. In FIG. 1, dotted arrows indicate the flow of refrigerant in heating operation. In heating operation, the refrigerant circuit is configured such that the flow path of refrigerant is switched by the refrigerant flow switching device 4 as indicated by the dotted arrows, causing a high-temperature, high-pressure refrigerant to flow to the load-side heat exchanger 7. In heating operation, the refrigerant flows in a direction opposite to that in cooling operation, with the load-side heat exchanger 7 acting as a condenser. That is, in the load-side heat exchanger 7, heat is exchanged between the refrigerant being circulated in the load-side heat exchanger 7, and the air being sent by the indoor air-blowing fan 7*f*, and the condensation heat of the refrigerant is rejected to the air being sent. The air sent by the indoor air-blowing fan 7*f* is thus heated as the refrigerant rejects heat.

Figure 2:
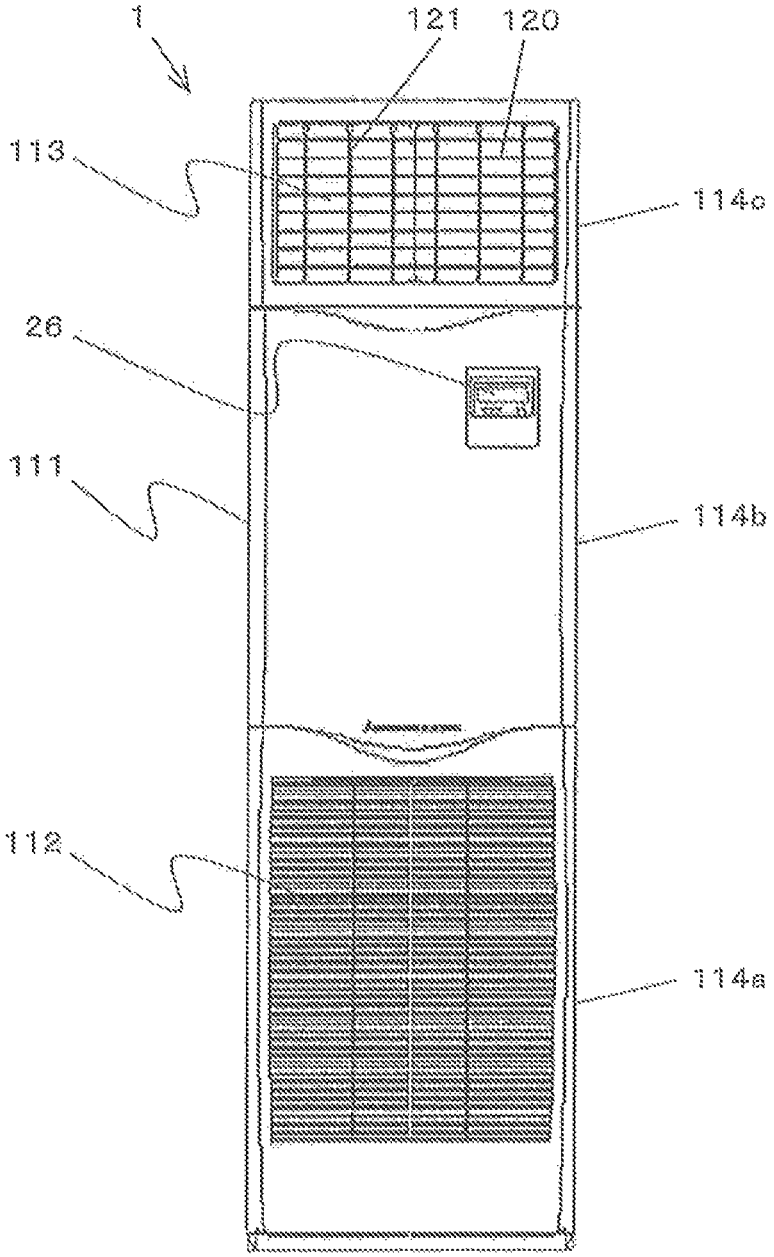
FIG. 2 is an external front view of an indoor unit 1 of the refrigeration cycle apparatus according to Embodiment 1 of the present invention.
Figure 3:
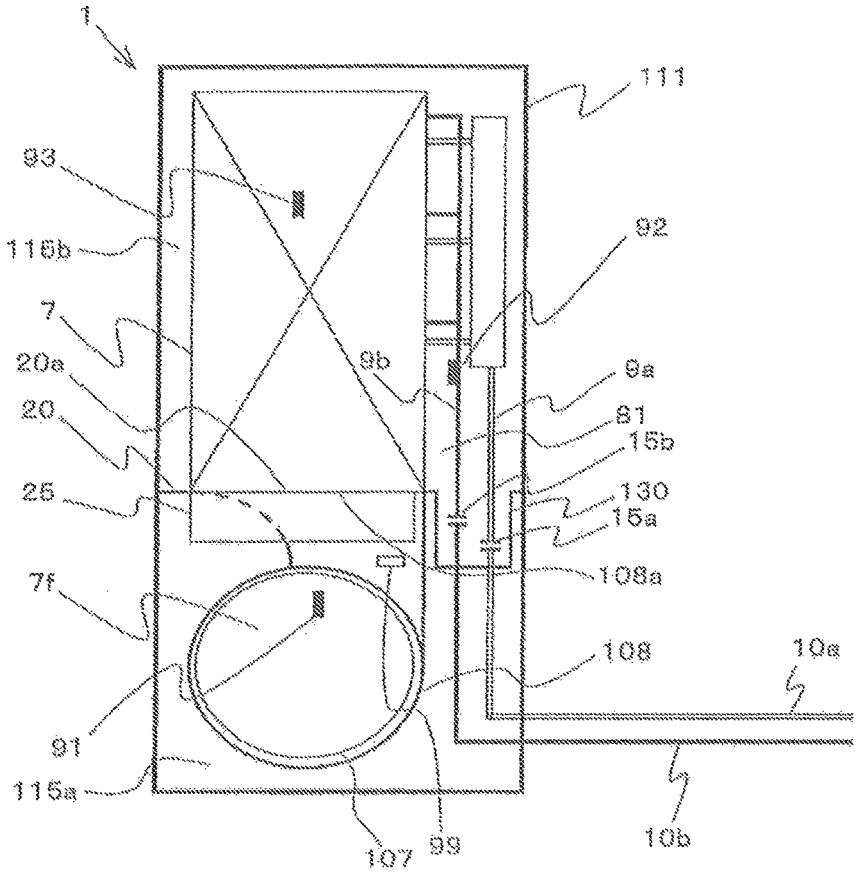
FIG. 3 is a schematic front view of the indoor unit 1 of the refrigeration cycle apparatus according to Embodiment 1 of the present invention, illustrating the internal structure of the indoor unit 1.
Figure 4:
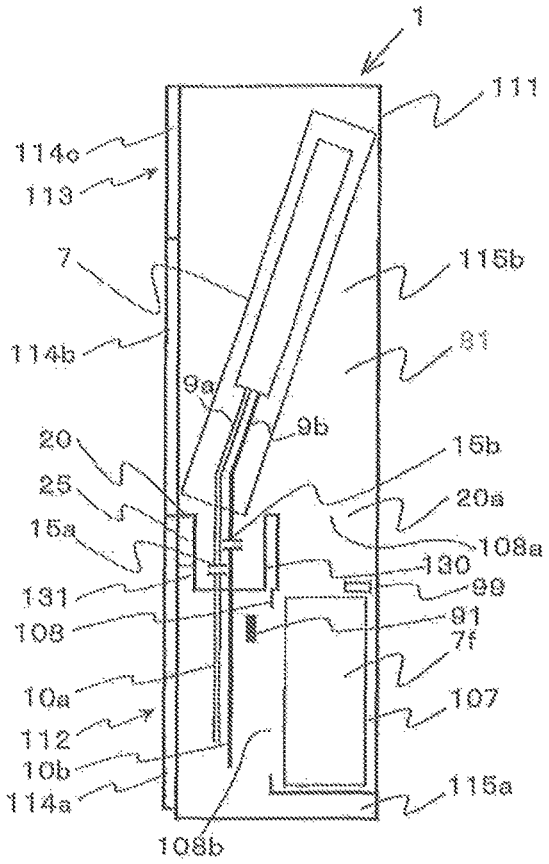
FIG. 4 is a schematic side view of the indoor unit 1 of the refrigeration cycle apparatus according to Embodiment 1 of the present invention, illustrating the internal structure of the indoor unit 1.

FIG. 2 is an external front view of the indoor unit 1 of the air-conditioning apparatus according to Embodiment 1. FIG. 3 is a front view of the indoor unit 1 illustrating the internal structure of the indoor unit 1 (with front panels removed). FIG. 4 is a side view of the indoor unit 1 illustrating the internal structure of the indoor unit 1. The left-hand side in FIG. 4 indicates the front side of the indoor unit 1. In Embodiment 1, the indoor unit 1 is illustrated to be of a floor-standing type placed on the floor surface of the indoor space that is the air-conditioned space.

As illustrated in FIGS. 2 to 4, the indoor unit 1 includes a housing 111 with a vertically elongated rectangular parallelepiped shape. An air inlet 112 for sucking in indoor air is provided in a lower part of the front face of the housing 111. The air inlet 112 in the present example is located at a position below the vertically central part of the housing 111 and near the floor surface. An air outlet 113 for blowing the air sucked in through the air inlet 112 into the indoor space is provided in an upper part of the front face of the housing 111, that is, at a position higher than the air inlet 112 (for example, above the vertically central part of the housing 111). The operating unit 26 is located at a position on the front face of the housing 111 above the air inlet 112 and below the air outlet 113. The operating unit 26 is connected to the controller 30 via a communication line, allowing data to be communicated between the operating unit 26 and the controller 30. As described above, the operating unit 26 is operated by the user to perform functions such as starting and ending the operation of the indoor unit 1 (air-conditioning apparatus), switching operation modes, and setting a preset temperature and a preset air volume. The operating unit 26 may be provided with components such as a display unit and an audio output unit to provide information to the user.

At least one up/down air flow deflection louver 120 and at least one left/right air flow deflection louver 121 are disposed at the air outlet 113. The up/down air flow deflection louver 120 adjusts the up/down direction of the flow of air blown out from the air outlet 113. The left/right air flow deflection louver 121 adjusts the left/right direction of the flow of air blown out from the air outlet 113. Hereinafter, when it is necessary to differentiate between a plurality of up/down air flow deflection louvers 120, these individual up/down air flow deflection louvers 120 will be sometimes referred to as up/down air flow deflection louvers 120*a*, 120*b*, 120*c*, and so on. Further, when it is necessary to differentiate between a plurality of left/right air flow deflection louvers 121, these individual left/right air flow deflection louvers 121 will be sometimes referred to as left/right air flow deflection louvers 121*a*, 121*b*, 121*c*, and so on.

The housing 111 is in the form of a hollow box with a front opening provided on the front face of the housing 111. The housing 111 includes a first front panel 114*a*, a second front panel 114*b*, and a third front panel 114*c* that are detachably attached over the front opening. Each of the first front panel 114*a*, the second front panel 114*b*, and the third front panel 114*c* has a substantially rectangular, flat outer shape. The first front panel 114*a* is detachably attached over a lower part of the front opening of the housing 111. The first front panel 114*a* is provided with the air inlet 112 mentioned above. The second front panel 114*b* is disposed above and adjacent to the first front panel 114*a*, and detachably attached over the vertically central part of the front opening of the housing 111. The second front panel 114*b* is provided with the operating unit 26 mentioned above. The third front panel 114*c* is disposed above and adjacent to the second front panel 114*b*, and detachably attached over an upper part of the front opening of the housing 111. The third front panel 114*c* is provided with the air outlet 113 mentioned above.

The internal space of the housing 111 is roughly divided into a lower space 115*a* serving as an air-blowing portion, and an upper space 115*b* located above the lower space 115*a* and serving as a heat exchange portion. The lower space 115*a* and the upper space 115*b* are partitioned off by a partition plate 20 that is disposed substantially horizontally and has the shape of a flat plate. The partition plate 20 is provided with at least an air passage opening 20*a* that allows communication between the lower space 115*a* and the upper space 115*b*. The lower space 115*a* is exposed to the front side when the first front panel 114*a* is detached from the housing 111. The upper space 115*b* is exposed to the front side when the second front panel 114*b* and the third front panel 114*c* are detached from the housing 111. That is, the partition plate 20 is placed at substantially the same height as the height of the upper end of the first front panel 114*a* (or the lower end of the second front panel 114*b*).

The indoor air-blowing fan 7*f* is disposed in the lower space 115*a* to create a flow of air that travels toward the air outlet 113 from the air inlet 112. The indoor air-blowing fan 7*f* in the present example is a sirocco fan including a motor (not illustrated), and an impeller 107 connected to the output shaft of the motor and having a plurality of blades arranged circumferentially at equal intervals. The rotating shaft of the impeller 107 (the output shaft of the motor) is disposed substantially in parallel to the direction of the depth of the housing 111. The impeller 107 of the indoor air-blowing fan 7*f* is covered by a fan casing 108 having a spiral shape. The fan casing 108 is formed as a component separate from, for example, the housing 111. An air inlet opening 108*b* for sucking in the air to be sent is located near the center of the spiral of the fan casing 108. The air inlet opening 108*b* is positioned facing the air inlet 112. Further, an air outlet opening 108*a* for blowing out the air to be sent is located in the direction of the tangent to the spiral of the fan casing 108. The air outlet opening 108*a* is oriented upward, and connected to the upper space 115*b* via the air passage opening 20*a* of the partition plate 20. In other words, the air outlet opening 108*a* communicates with the upper space 115*b* via the air passage opening 20*a*. The open end of the air outlet opening 108*a* and the open end of the air passage opening 20*a* may be directly connected with each other, or may be indirectly connected with each other via a component such as a duct member. At least the interior of the fan casing 108 in the lower space 115*a* constitutes a part of an air passage space 81. The air passage space 81 refers to a space inside the housing 111 that serves as a passage for the air travelling from the air inlet 112 toward the air outlet 113.

In Embodiment 1, the air passage extending through the air outlet opening 108*a* and the air passage opening 20*a* is practically the sole path that allows the lower space 115*a* and the upper space 115*b* to communicate with each other inside the housing 111.

For example, a microcomputer that constitutes, for example, the controller 30, and an electrical component box 25 that accommodates components such as various electrical components and a board are disposed in the lower space 115*a*.

The load-side heat exchanger 7 is disposed in the air passage space 81 within the upper space 115*b*. A drain pan (not illustrated) is provided below the load-side heat exchanger 7 to receive condensed water that has condensed on the surface of the load-side heat exchanger 7. The drain pan may be formed as a part of the partition plate 20, or may be formed as a component separate from the partition plate 20 and disposed on the partition plate 20.

A part of the partition plate 20 near the indoor pipes 9*a* and 9*b* and the extension pipes 10*a* and 10*b* is provided with a recess 130 where the partition plate 20 is recessed as seen from the upper space 115*b* and protrudes as seen from the lower space 115*a*. The space inside the recess 130, which constitutes a part of the upper space 115*b*, is located at a height lower than the upper end of the first front panel 114*a* (the lower end of the second front panel 114*b*). An opening is provided on the front side of the recess 130. The opening is provided with a lid 131 that can be detachably attached over the opening by using a device such as a screw. When the lid 131 is detached, the space inside the recess 130 is exposed to the front side through the opening. When the lid 131 is attached, the front side of the recess 130 is hermetically closed.

The couplings 15*a* and 15*b* are disposed in the space inside the recess 130. That is, the couplings 15*a* and 15*b* are disposed below the upper end of the first front panel 114*a*. This configuration allows the couplings 15*a* and 15*b* to be exposed to the front side by detaching the first front panel 114*a* and further detaching the lid 131.

The refrigerant detection unit 99 that detects a refrigerant leak is located at a position inside the fan casing 108 and above the indoor air-blowing fan 7*f* (for example, above the impeller 107). As the refrigerant detection unit 99, a gas sensor (for example, a semiconductor gas sensor or a hot-wire type semiconductor gas sensor) is used. The refrigerant detection unit 99 detects, for example, the concentration of refrigerant in the air around the refrigerant detection unit 99, and outputs the resulting detection signal to the controller 30. The controller 30 determines whether there is a refrigerant leak based on the detection signal output from the refrigerant detection unit 99.

Figure 5:
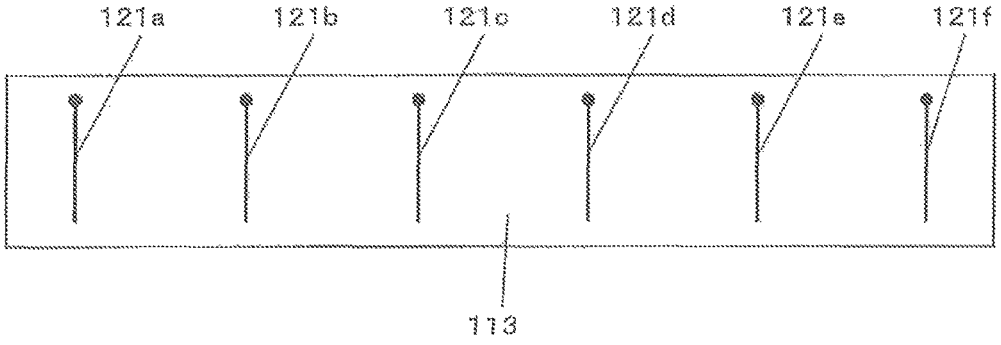
FIG. 5 is a schematic top view of an air outlet 113 and left/right air flow deflection louvers 121*a* to 121*f* of the indoor unit 1 of the refrigeration cycle apparatus according to Embodiment 1 of the present invention.
Figure 6:
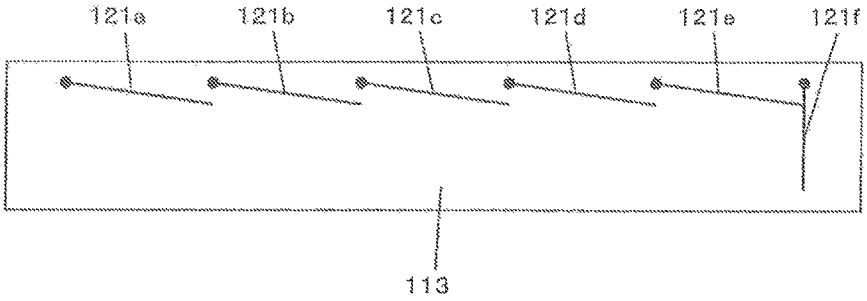
FIG. 6 is a schematic top view of the air outlet 113 and the left/right air flow deflection louvers 121*a* to 121*f* of the indoor unit 1 of the refrigeration cycle apparatus according to Embodiment 1 of the present invention.

FIGS. 5 and 6 are schematic top views of the air outlet 113 and left/right air flow deflection louvers 121*a*, 121*b*, 121*c*, 121*d*, 121*e*, and 121*f* disposed at the air outlet 113. The upper side in FIGS. 5 and 6 represents the upstream side with respect to the flow of blowing air. FIG. 5 depicts an open state in which air is blown out from the air outlet 113, and FIG. 6 depicts a closed state in which the air outlet 113 has a decreased opening area relative to the open state.

As illustrated in FIGS. 5 and 6, the left/right air flow deflection louvers 121*a* to 121*f* in the present example each have a cantilevered configuration with a rotational axis located on the upstream side with respect to the flow of blowing air. Each of the left/right air flow deflection louvers 121*a* to 121*e* is attached such that the left/right air flow deflection louvers 121*a* to 121*e* are rotatable about the rotational axis extending in the vertical direction. The left/right air flow deflection louver 121*f* located at the rightmost end is secured in place such that the left/right air flow deflection louver 121*f* is oriented perpendicular to the opening end of the air outlet 113. The left/right air flow deflection louvers 121*a* to 121*e* are controlled by the controller 30 such that the left/right air flow deflection louvers 121*a* to 121*e* are driven to rotate within their predetermined movable range by means of a drive mechanism (including, for example, a motor and a link mechanism) (not illustrated).

In the open state illustrated in FIG. 5, the left/right air flow deflection louvers 121*a* to 121*e* are driven to rotate such that the left/right air flow deflection louvers 121*a* to 121*e* are oriented perpendicular to the open end of the air outlet 113. This causes all of the left/right air flow deflection louvers 121*a* to 121*e* and the left/right air flow deflection louver 121*f* to become oriented perpendicular to the open end of the air outlet 113, resulting in the maximum opening area of the air outlet 113. The opening area of the air outlet 113 refers to an opening area when viewed perpendicularly to the open end of the air outlet 113 (that is, from the front of the air outlet 113). In the closed state illustrated in FIG. 6, the left/right air flow deflection louvers 121*a* to 121*e* are driven to rotate such that the left/right air flow deflection louvers 121*a* to 121*e* become oriented in a direction closer to the direction parallel to the open end of the air outlet 113. This causes the opening area of the air outlet 113 to decrease relative to the open state.

Although the left/right air flow deflection louver 121 has been described above with reference to FIGS. 5 and 6, the above-mentioned configuration is also applicable to the up/down air flow deflection louver 120. Although other examples described later will be sometimes directed to the configuration of only one of the left/right air flow deflection louver 121 and the up/down air flow deflection louver 120, such a configuration is equally applicable to the other one of the left/right air flow deflection louver 121 and the up/down air flow deflection louver 120.

Figure 7:
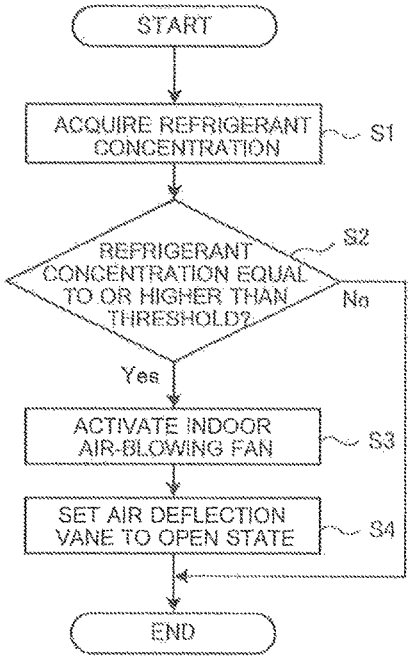
FIG. 7 is a flowchart illustrating an example of a refrigerant leak detection process executed by a controller 30 in the refrigeration cycle apparatus according to Embodiment 1 of the present invention.

FIG. 7 is a flowchart illustrating an example of a refrigerant leak detection process executed by the controller 30. This refrigerant leak detection process is repeatedly executed at predetermined time intervals either on a constant basis, including when the air-conditioning apparatus is operating and when the air-conditioning apparatus is stopped, or only when the air-conditioning apparatus is stopped.

At step S1, the controller 30 acquires, based on a detection signal from the refrigerant detection unit 99, information on the concentration of refrigerant around the refrigerant detection unit 99.

Next, it is determined at step S2 whether the concentration of refrigerant around the refrigerant detection unit 99 is equal to or higher than a preset threshold. If it is determined that the refrigerant concentration is equal to or higher than the threshold, the process proceeds to step S3. If it is determined that the refrigerant concentration is less than the threshold, the process is ended.

At step S3, the operation of the indoor air-blowing fan 7*f* is started. If the indoor air-blowing fan 7*f* is already operating, the operation is continued as it is. At step S3, components such as a display unit and a voice output unit provided in the operating unit 26 may be used to inform the user that leakage of refrigerant has occurred.

Next, at step S4, the air flow deflection louver (for example, at least one of the left/right air flow deflection louver and the up/down air flow deflection louver) is set to an open state. If the air flow deflection louver is already in an open state, that state is maintained as it is. The order of step S3 and step S4 may be interchanged.

As described above, in the refrigerant leak detection process, the operation of the indoor air-blowing fan 7*f* is started when leakage of refrigerant is detected (that is, if the refrigerant concentration detected by the refrigerant detection unit 99 is equal to or higher than a threshold). If leakage of refrigerant is detected, the air flow deflection louver (at least one of the left/right air flow deflection louver and the up/down air flow deflection louver) disposed at the air outlet 113 is set to an open state. This ensures that an air passage for air to pass through is established in the air outlet 113 at least when leakage of the refrigerant is detected. As a result, indoor air is sucked in through the air inlet 112, and a sufficient amount of the sucked indoor air is blown out from the air outlet 113. This allows the leaked refrigerant to be effectively dispersed in the indoor space, thus reducing the occurrence of locally increased refrigerant concentrations in the indoor space.

Embodiment 1 uses a flammable refrigerant such as R-32, HFO-1234yf, HFO-1234ze, R-290, or R-1270. Accordingly, local increases in indoor refrigerant concentration can lead to formation of a flammable concentration region in the indoor space.

These flammable refrigerants have densities greater than that of air under atmospheric pressures. Therefore, if a refrigerant leak occurs at a relatively high position above the indoor floor surface, the leaked refrigerant is dispersed as the refrigerant travels downward. This allows refrigerant concentration to even out in the indoor space, thus reducing the occurrence of high refrigerant concentrations. By contrast, if a refrigerant leak occurs at a low position above the indoor floor surface, the leaked refrigerant builds up at a low position near the floor surface, leading to a higher occurrence of locally increased refrigerant concentrations. This leads to a relatively higher risk of formation of a flammable concentration region.

While the air-conditioning apparatus is operating, the indoor air-blowing fan 7*f* of the indoor unit 1 is driven to blow air indoors. This ensures that no flammable concentration region is created in the indoor space in the event that a flammable refrigerant leaks out into the indoor space, as the leaked flammable refrigerant is dispersed in the indoor space by the air blown out from the air outlet 113. While the air-conditioning apparatus is stopped, however, the indoor air-blowing fan 7*f* of the indoor unit 1 is also stopped, making it impossible to disperse the leaked refrigerant. This makes detection of leaked refrigerant all the more necessary while the air-conditioning apparatus is stopped.

In the indoor unit 1, areas prone to refrigerant leaks are the brazed joint of the load-side heat exchanger 7 and the couplings 15*a* and 15*b*. In Embodiment 1, the load-side heat exchanger 7 and the couplings 15*a* and 15*b* are disposed in the air passage space 81 within the upper space 115*b*, that is, in the air passage space 81 located above the fan casing 108 disposed in the lower space 115*a*. Further, the air outlet opening 108*a* of the fan casing 108 is connected to the air passage opening 20*a* of the partition plate 20. Thus, if a refrigerant leak occurs at the brazed joint of the load-side heat exchanger 7 or at the coupling 15*a* or 15*b* while the air-conditioning apparatus is stopped (that is, while the indoor air-blowing fan 7*f* is stopped), substantially the entire amount of the refrigerant that has leaked out to the upper space 115*b* flows down into the fan casing 108 via the air passage opening 20*a* and the air outlet opening 108*a*, without being routed through other paths within the housing 111. Therefore, if a refrigerant leak occurs at the brazed joint of the load-side heat exchanger 7 or at the coupling 15*a* or 15*b*, the concentration of refrigerant within the fan casing 108 can be quickly increased. In Embodiment 1, the refrigerant detection unit 99 is disposed inside the fan casing 108, and thus the concentration of refrigerant around the refrigerant detection unit 99 can be quickly increased. This enables earlier and more reliable detection of refrigerant leakage. This also allows earlier and more reliable responses to be taken, such as activating the indoor air-blowing fan 7*f* to disperse leaked refrigerant, and informing the user of a refrigerant leak. This configuration proves particularly effective for the indoor unit 1 of a floor-standing type, in which a refrigerant leak to the indoor space tends to occur at a low position near the floor surface and the leaked refrigerant tends to build up at a low position near the floor surface to form a flammable concentration region.

In Embodiment 1, irrespective of whether a refrigerant leak occurs at the brazed joint of the load-side heat exchanger 7 or at the coupling 15*a* or 15*b*, the entire amount of the leaked refrigerant can be routed into the fan casing 108. This means that the presence of a single refrigerant detection unit 99 within the fan casing 108 is sufficient to enable earlier and more reliable detection of refrigerant leakage, without the need for the refrigerant detection unit 99 to be present at each one of a plurality of sites prone to refrigerant leaks. Therefore, the number of the refrigerant detection units 99 can be reduced, enabling a reduction in the cost of manufacturing the indoor unit 1 as well as the air-conditioning apparatus including the indoor unit 1.

The indoor air-blowing fan 7*f* (the impeller 107) with a plurality of blades is disposed inside the fan casing 108. Thus, the refrigerant that has flown down into the fan casing 108 flows downward while striking against the surfaces of the blades of the indoor air-blowing fan 7*f* and splitting into separate streams flowing through a plurality of flow paths defined by the individual blades. Thus, once the refrigerant that has flown down into the fan casing 108 reaches the indoor air-blowing fan 7*f*, the refrigerant is dispersed into the air. This causes the concentration of the refrigerant to drop. Since the refrigerant detection unit 99 is disposed above the indoor air-blowing fan 7*f* in Embodiment 1, refrigerant at a high concentration prior to being dispersed can be detected.

In Embodiment 1, the couplings 15*a* and 15*b*, which are disposed within the upper space 115*b*, are located below the upper end of the first front panel 114*a*. Thus, detaching the first front panel 114*a* and the lid 131 causes the couplings 15*a* and 15*b* to be exposed to the front side. Further, the electrical component box 25 is also located below the upper end of the first front panel 114*a*. Embodiment 1 thus allows electric wiring and refrigerant pipes to be connected or disconnected without detaching the second front panel 114*b*. This facilitates work such as installation, repair, or dismantling of the indoor unit 1. In normal use conditions with the lid 131 attached over the recess 130, the front side of the recess 130 is hermetically closed. Thus, if refrigerant leaks out at the coupling 15*a* or 15*b*, substantially the entire amount of the leaked refrigerant can be routed into the fan casing 108 via the air passage opening 20*a* and the air outlet opening 108*a*, without being routed through other paths within the housing 111.

Figure 8:
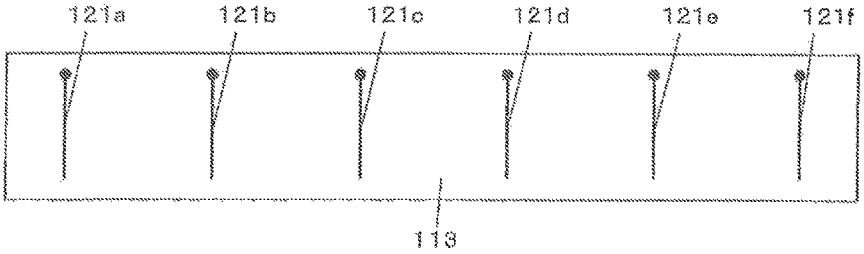
FIG. 8 is a schematic top view of the air outlet 113 and the left/right air flow deflection louvers 121*a* to 121*f* of the indoor unit 1 of a refrigeration cycle apparatus according to a first modification of Embodiment 1 of the present invention.
Figure 9:
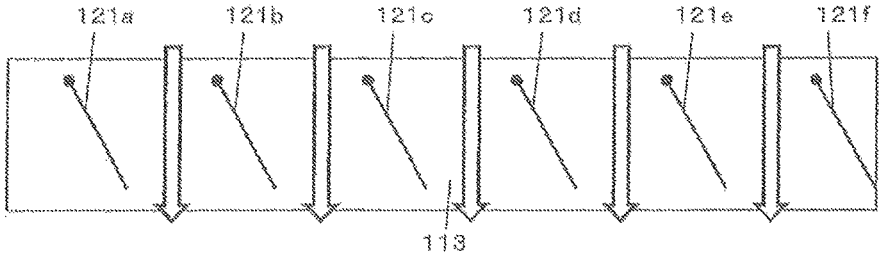
FIG. 9 is a schematic top view of the air outlet 113 and the left/right air flow deflection louvers 121*a* to 121*f* of the indoor unit 1 of the refrigeration cycle apparatus according to the first modification of Embodiment 1 of the present invention.
Figure 10:
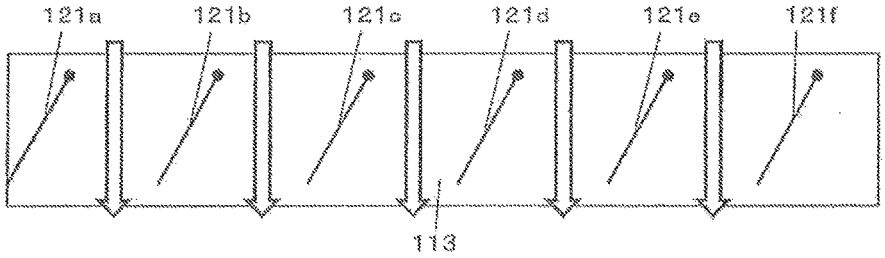
FIG. 10 is a schematic top view of the air outlet 113 and the left/right air flow deflection louvers 121*a* to 121*f* of the indoor unit 1 of the refrigeration cycle apparatus according to the first modification of Embodiment 1 of the present invention.
Figure 11:
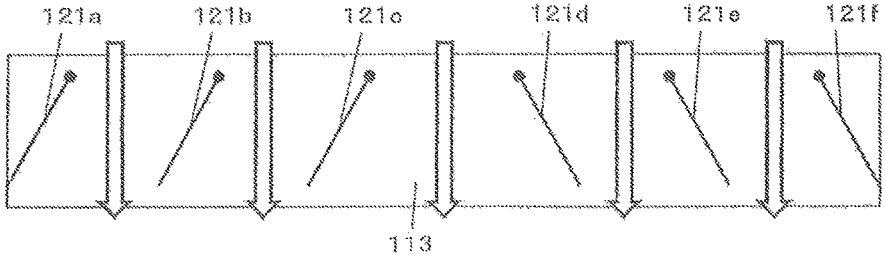
FIG. 11 is a schematic top view of the air outlet 113 and the left/right air flow deflection louvers 121*a* to 121*f* of the indoor unit 1 of the refrigeration cycle apparatus according to the first modification of Embodiment 1 of the present invention.

FIGS. 8 to 11 are schematic top views of the air outlet 113 and the left/right air flow deflection louvers 121*a* to 121*f* of the indoor unit 1 according to a first modification of Embodiment 1. FIG. 8 illustrates a frontal blowing state in which air is blown frontally from the air outlet 113. FIG. 9 illustrates a right blowing state in which air is blown rightward from the air outlet 113. FIG. 10 illustrates a left blowing state in which air is blown leftward from the air outlet 113. FIG. 11 illustrates a left/right blowing state in which air is blown out both leftward and rightward from the air outlet 113. The left/right air flow deflection louvers 121*a* to 121*f* according to the first modification modification are not limited to those operated under control by the controller 30 but may be operated manually by the user.

In the state illustrated in FIG. 8, the six left/right air flow deflection louvers 121*a* to 121*f* are oriented perpendicular to the open end of the air outlet 113. An air passage is thus established in substantially the entire air outlet 113.

In the state illustrated in FIG. 9, the left/right air flow deflection louvers 121*a* to 121*f* are rotated rightward (counter-clockwise) to the maximum angle within a movable range. In this state as well, an air passage is established in the area of the air outlet 113 between the left/right air flow deflection louvers 121*a* to 121*f* that are adjacent to each other. The present example ensures that even when the left/right air flow deflection louvers 121*a* to 121*f* are rotated rightward to the maximum angle within a movable range, the left/right air flow deflection louvers 121*a* to 121*f* that are adjacent to each other do not overlap as viewed from the front of the air outlet 113.

In the state illustrated in FIG. 10, the left/right air flow deflection louvers 121*a* to 121*f* are rotated leftward (clockwise) to the maximum angle within a movable range. In this state as well, an air passage is established in the area of the air outlet 113 between the left/right air flow deflection louvers 121*a* to 121*f* that are adjacent to each other. The present example ensures that even when the left/right air flow deflection louvers 121*a* to 121*f* are rotated leftward to the maximum angle within a movable range, the left/right air flow deflection louvers 121*a* to 121*f* that are adjacent to each other do not overlap as viewed from the front of the air outlet 113.

In the state illustrated in FIG. 11, the left/right air flow deflection louvers 121*a* to 121*c* are rotated leftward to the maximum angle within a movable range. The left/right air flow deflection louvers 121*d* to 121*f* are rotated rightward to the maximum angle within a movable range. In this state as well, an air passage is established in the area of the air outlet 113 between the left/right air flow deflection louvers 121*a* to 121*f* that are adjacent to each other.

As illustrated in FIGS. 8 to 11, the first modification ensures that an air passage is established in the air outlet 113 irrespective of how the left/right air flow deflection louvers 121*a* to 121*f* are oriented within a movable range. The thick arrows in FIGS. 9 to 11 and in other figures described later such as FIGS. 13 to 15 each represent an example of an air passage established in the air outlet 113, and do not necessarily represent the direction of airflow.

Figure 12:
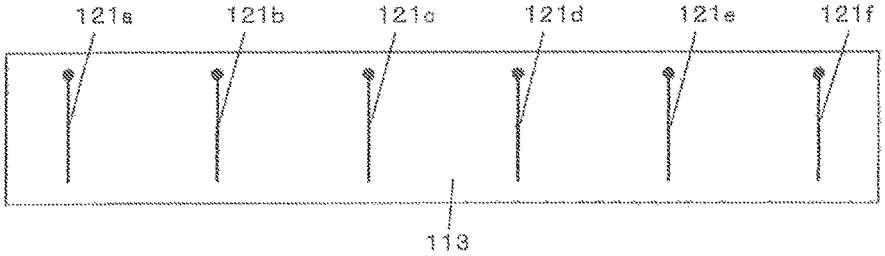
FIG. 12 is a schematic top view of the air outlet 113 and the left/right air flow deflection louvers 121*a* to 121*f* of the indoor unit 1 of a refrigeration cycle apparatus according to a second modification of Embodiment 1 of the present invention.
Figure 13:
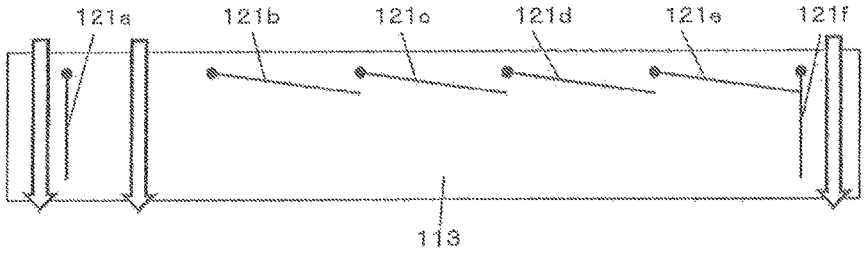
FIG. 13 is a schematic top view of the air outlet 113 and the left/right air flow deflection louvers 121*a* to 121*f* of the indoor unit 1 of the refrigeration cycle apparatus according to the second modification of Embodiment 1 of the present invention.
Figure 14:
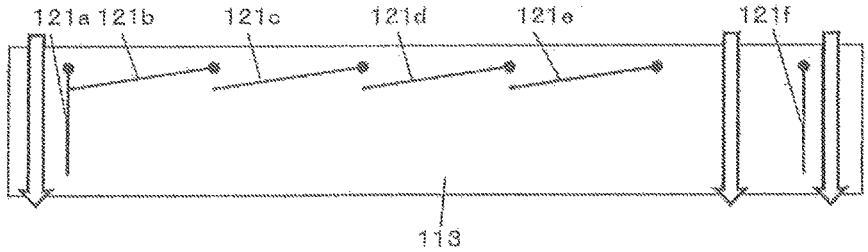
FIG. 14 is a schematic top view of the air outlet 113 and the left/right air flow deflection louvers 121*a* to 121*f* of the indoor unit 1 of the refrigeration cycle apparatus according to the second modification of Embodiment 1 of the present invention.
Figure 15:
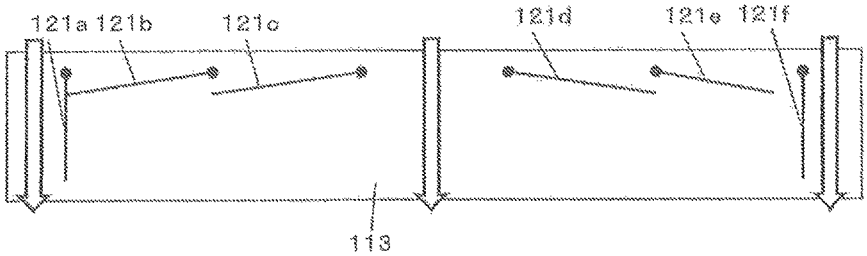
FIG. 15 is a schematic top view of the air outlet 113 and the left/right air flow deflection louvers 121*a* to 121*f* of the indoor unit 1 of the refrigeration cycle apparatus according to the second modification of Embodiment 1 of the present invention.

FIGS. 12 to 15 are schematic top views of the air outlet 113 and the left/right air flow deflection louvers 121*a* to 121*f* of the indoor unit 1 according to a second modification of Embodiment 1. FIG. 12 illustrates a frontal blowing state, FIG. 13 illustrates a right blowing state, FIG. 14 illustrates a left blowing state, and FIG. 15 illustrates a left/right blowing state.

In the state illustrated in FIG. 13, the four left/right air flow deflection louvers 121*b* to 121*e* (an example of middle air flow deflection louvers) located in the horizontally middle part are rotated rightward to the maximum angle within a movable range. The left/right air flow deflection louvers 121*a* and 121*f* (an example of air flow deflection louvers at both ends), which are located at both ends with the left/right air flow deflection louvers 121*b* to 121*e* therebetween, are fixed in position with respect to the air outlet 113. This configuration ensures that an air passage is established in each of the following areas of the air outlet 113: the area to the left of the left/right air flow deflection louver 121*a*, the area between the left/right air flow deflection louvers 121*a* and 121*b*, and the area to the right of the left/right air flow deflection louver 121*f*.

In the state illustrated in FIG. 14, the left/right air flow deflection louvers 121*b* to 121*e* are rotated leftward to the maximum angle within a movable range. The left/right air flow deflection louvers 121*a* and 121*f* are fixed in position with respect to the air outlet 113. This configuration ensures that an air passage is established in each of the following areas of the air outlet 113: the area to the left of the left/right air flow deflection louver 121*a*, the area between the left/right air flow deflection louvers 121*e* and 121*f* and the area to the right of the left/right air flow deflection louver 121*f*.

In the state illustrated in FIG. 15, the left/right air flow deflection louvers 121*b* and 121*c* are rotated leftward to the maximum angle within a movable range. The left/right air flow deflection louvers 121*d* and 121*e* are rotated rightward to the maximum angle within a movable range. The left/right air flow deflection louvers 121*a* and 121*f* are fixed in position with respect to the air outlet 113. This configuration ensures that an air passage is established in each of the following areas of the air outlet 113: the area to the left of the left/right air flow deflection louver 121*a*, the area between the left/right air flow deflection louvers 121*c* and 121*d*, and the area to the right of the left/right air flow deflection louver 121*f*.

As illustrated in FIGS. 12 to 15, the second modification ensures that an air passage is established in the air outlet 113 irrespective of how the left/right air flow deflection louvers 121*a* to 121*f* are oriented within a movable range.

Figure 16:
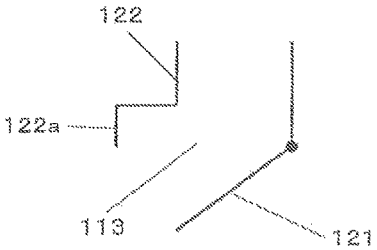
FIG. 16 is a schematic top view of the air outlet 113 and a left/right air flow deflection louver 121 of the indoor unit 1 of a refrigeration cycle apparatus according to a third modification of Embodiment 1 of the present invention.
Figure 17:
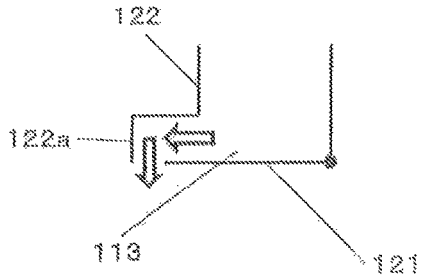
FIG. 17 is a schematic top view of the air outlet 113 and the left/right air flow deflection louver 121 of the indoor unit 1 of the refrigeration cycle apparatus according to the third modification of Embodiment 1 of the present invention.

FIGS. 16 and 17 are schematic top views of the air outlet 113 and the left/right air flow deflection louver 121 of the indoor unit 1 according to a third modification of Embodiment 1. The upper side in FIGS. 16 and 17 represents the upstream side with respect to the flow of air being blown out. FIG. 16 depicts an open state (for example, the state when the indoor air-blowing fan 7*f* is running) in which air is blown out from the air outlet 113, and FIG. 17 depicts a closed state (for example, the state when the indoor air-blowing fan 7*f* is stopped) in which the air outlet 113 has a decreased opening area relative to the open state.

As illustrated in FIGS. 16 and 17, a side wall 122 that defines the air passage through the air outlet 113 has an clearance part 122*a* that is protruded outward relative to the left/right air flow deflection louver 121. The presence of the clearance part 122*a* allows the open end of the air outlet 113 to have an area larger than the area to be closed by the left/right air flow deflection louver 121. As illustrated in FIG. 17, an air passage is established in the air outlet 113 even when the left/right air flow deflection louver 121 is in its closed state. That is, the third modification ensures that an air passage is established in the air outlet 113 irrespective of how the left/right air flow deflection louver 121 is oriented within a movable range.

Figure 18:
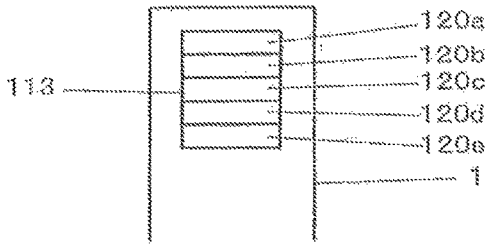
FIG. 18 is a schematic front view of the indoor unit 1 of a refrigeration cycle apparatus according to a fourth modification of Embodiment 1 of the present invention, illustrating the configuration in the vicinity of the air outlet 113.
Figure 19:
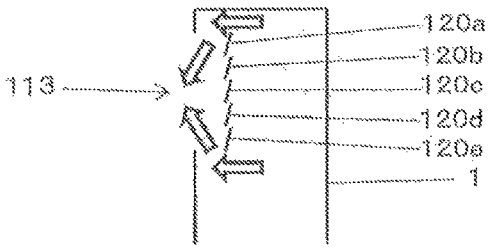
FIG. 19 is a schematic sectional view of the indoor unit 1 of the refrigeration cycle apparatus according to the fourth modification of Embodiment 1 of the present invention, illustrating the configuration in the vicinity of the air outlet 113.

FIG. 18 is a schematic front view of the indoor unit 1 according to a fourth modification of Embodiment 1, illustrating the configuration in the vicinity of the air outlet 113. FIG. 19 is a schematic sectional view of the indoor unit 1, illustrating the configuration in the vicinity of the air outlet 113. As illustrated in FIGS. 18 and 19, five up/down air flow deflection louvers 120*a*, 120*b*, 120*c*, 120*d*, and 120*e* are disposed at the air outlet 113 of the indoor unit 1 in this order in the direction from the top toward the bottom of the air outlet 113. The up/down air flow deflection louvers 120*a* to 120*e* are attached such that each of the up/down air flow deflection louvers 120*a* to 120*e* is rotatable about a rotational axis extending in the horizontal direction. In FIGS. 18 and 19, the up/down air flow deflection louvers 120*a* to 120*e* are in their closed state (for example, the state when the indoor air-blowing fan 7*f* is stopped).

The up/down air flow deflection louvers 120*a* to 120*e* are located at the back side relative to the open end of the air outlet 113. Thus, in at least one of the areas above, below, and to the side of the up/down air flow deflection louvers 120*a* to 120*e* in their closed state, air passages that go around the up/down air flow deflection louvers 120*a* to 120*e* are created as indicated by the thick arrows in FIG. 19. Thus, the fourth modification ensures that an air passage is established in the air outlet 113 irrespective of how the up/down air flow deflection louvers 120*a* to 120*e* are oriented within a movable range. In the fourth modification, when the up/down air flow deflection louvers 120*a* to 120*e* are in their closed state as illustrated in FIG. 18, the air outlet 113 appears to be closed by the up/down air flow deflection louvers 120*a* to 120*e* when viewed from the front of the indoor unit 1. This prevents the air outlet 113 from being viewed from the front of the indoor unit 1, allowing for enhanced design of the indoor unit 1.

Figure 20:
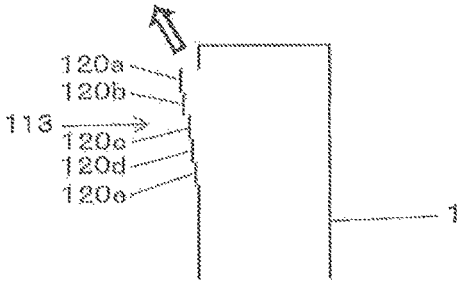
FIG. 20 is a schematic sectional view of the indoor unit 1 of a refrigeration cycle apparatus according to a fifth modification of Embodiment 1 of the present invention, illustrating the configuration in the vicinity of the air outlet 113.

FIG. 20 is a schematic sectional view of the indoor unit 1 according to a fifth modification of Embodiment 1, illustrating the configuration in the vicinity of the air outlet 113. As illustrated in FIG. 20, five up/down air flow deflection louvers 120*a*, 120*b*, 120*c*, 120*d*, and 120*e* are disposed at the air outlet 113 of the indoor unit 1 in this order in the direction from the top toward the bottom of the air outlet 113. The respective rotational axes of the up/down air flow deflection louvers 120*a*, 120*b*, 120*c*, 120*d*, and 120*e* lie in substantially the same plane. This plane, however, is inclined with respect to the open end of the air outlet 113 such that the plane is positioned more frontward as the plane extends upward. Thus, as indicated by the thick arrow in FIG. 20, an air passage that goes around the up/down air flow deflection louvers 120*a* to 120*e* is created in the area above the up/down air flow deflection louvers 120*a* to 120*e*. As a result, the fifth modification ensures that an air passage is established in the air outlet 113 irrespective of how the up/down air flow deflection louvers 120*a* to 120*e* are oriented within a movable range.

Figure 21:
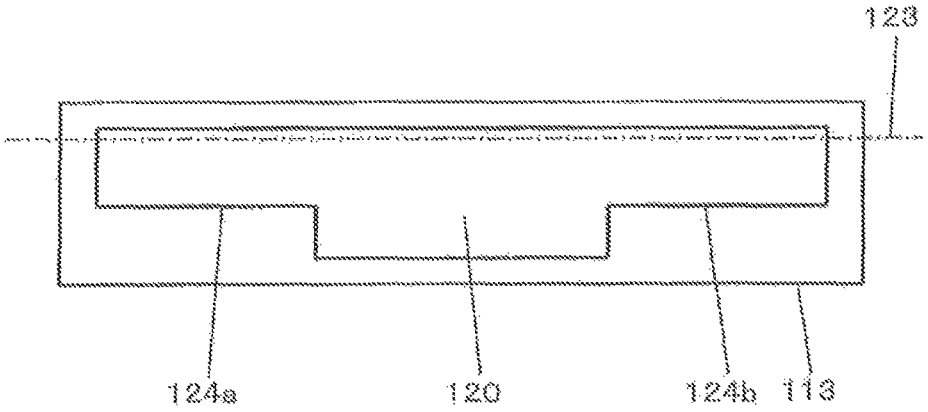
FIG. 21 is a schematic front view of the indoor unit 1 of a refrigeration cycle apparatus according to a sixth modification of Embodiment 1 of the present invention, illustrating the configuration in the vicinity of the air outlet 113.

FIG. 21 is a schematic front view of the indoor unit 1 according to a sixth modification of Embodiment 1, illustrating the configuration in the vicinity of the air outlet 113. As illustrated in FIG. 21, a single up/down air flow deflection louver 120 is disposed at the air outlet 113. The air outlet 113 has a rectangular shape. A rotational axis 123 of the up/down air flow deflection louver 120 lies along one edge (the upper edge in FIG. 21) of the up/down air flow deflection louver 120. The up/down air flow deflection louver 120 has rectangular cutouts 124*a* and 124*b* respectively located at the left and right end corners of the other edge (the lower edge in FIG. 21) of the up/down air flow deflection louver 120. This ensures that an air passage is established in each of the cutouts 124*a* and 124*b* even when the up/down air flow deflection louver 120 is in its closed state. Therefore, the sixth modification ensures that an air passage is established in the air outlet 113 irrespective of how the up/down air flow deflection louver 120 is oriented within a movable range.

As described above, in Embodiment 1, an air passage is established in the air outlet 113 at least when leakage of refrigerant is detected (for example, at all times). Accordingly, rotating the indoor air-blowing fan 7*f* at this time allows leaked refrigerant to be blown out from the air outlet 113 together with a sufficient amount of air. This enables effective dispersion of the leaked refrigerant. This makes it possible to reduce the occurrence of locally increased refrigerant concentrations in the indoor space in the event of a refrigerant leak.

Embodiment 2

Figure 22:
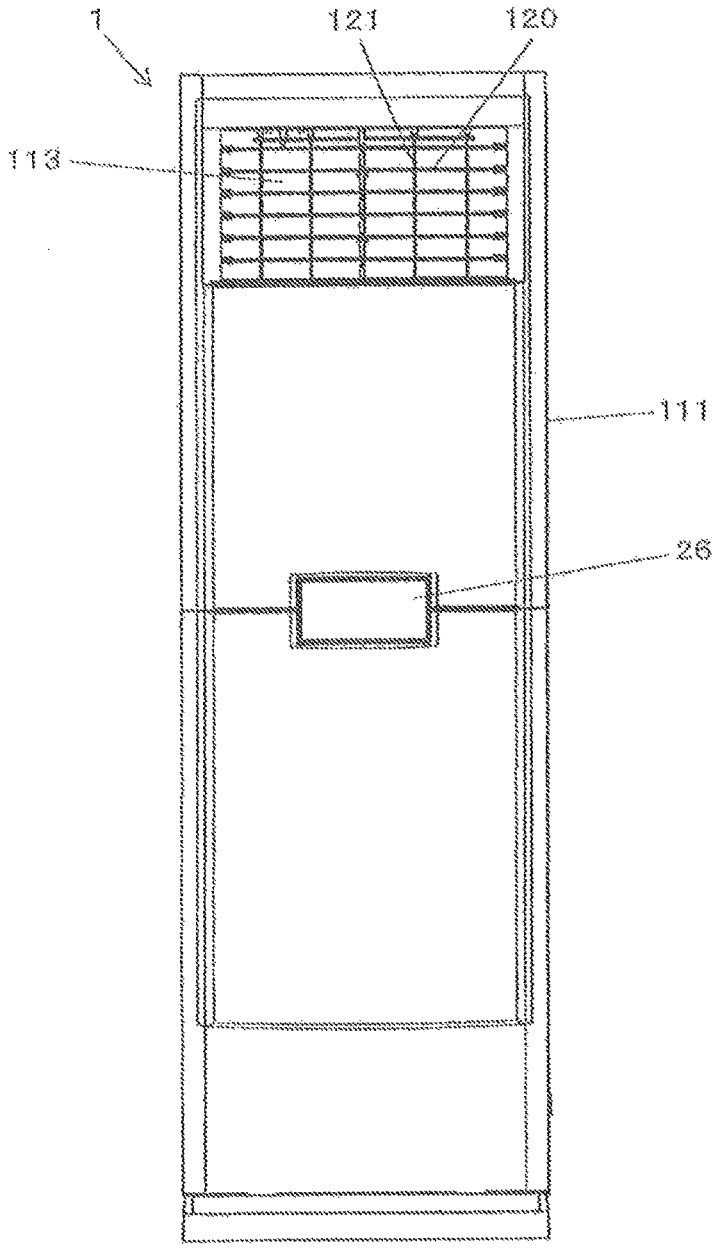
FIG. 22 is an external front view of the indoor unit 1 of a refrigeration cycle apparatus according to Embodiment 2 of the present invention.
Figure 23:
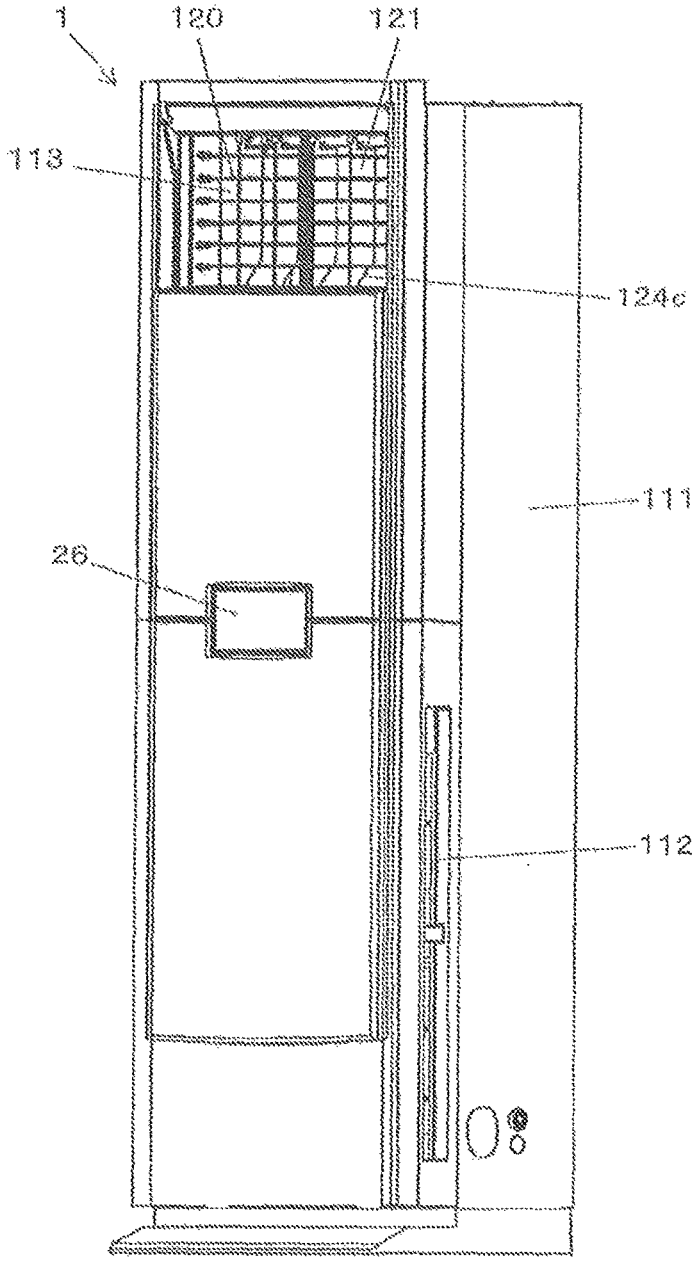
FIG. 23 is an external perspective view of the indoor unit 1 of the refrigeration cycle apparatus according to Embodiment 2 of the present invention.
Figure 24:
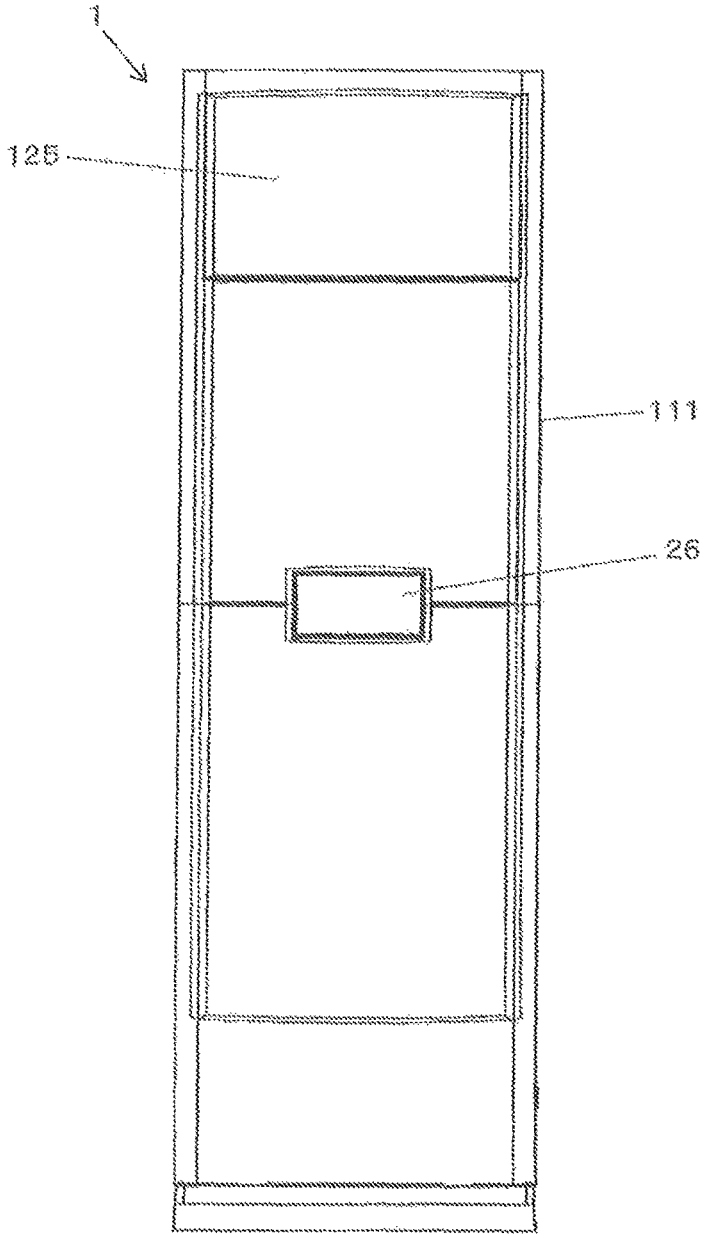
FIG. 24 is a front view, with a shutter 125 closed, of the indoor unit 1 of the refrigeration cycle apparatus according to Embodiment 2 of the present invention.
Figure 25:
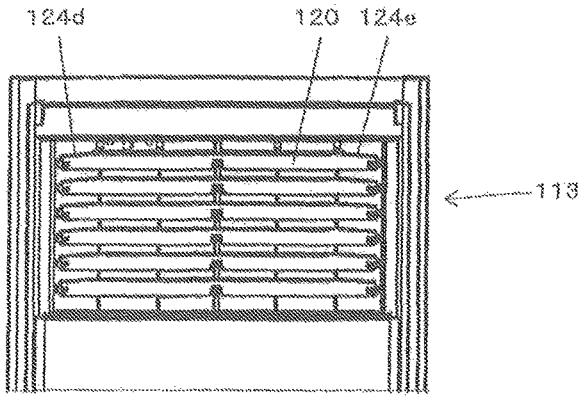
FIG. 25 is a front view of the indoor unit 1 of the refrigeration cycle apparatus according to Embodiment 2 of the present invention, illustrating the configuration in the vicinity of the air outlet 113.

A refrigeration cycle apparatus according to Embodiment 2 of the present invention will be described. FIG. 22 is an external front view of the indoor unit 1 of the refrigeration cycle apparatus according to Embodiment 2. FIG. 23 is an external perspective view of the indoor unit 1. FIG. 24 is a front view of the indoor unit 1, with a shutter 125 disposed at the air outlet 113 being closed. FIG. 25 is a front view of the indoor unit 1 illustrating the configuration in the vicinity of the air outlet 113. FIG. 25 depicts a state in which the up/down air flow deflection louver 120 is rotated to an obliquely upward orientation. Components having the same functions and operational effects as those in Embodiment 1 are denoted by the same reference signs to avoid their repetitive description.

As illustrated in FIGS. 22 to 25, the indoor unit 1 has the air inlet 112 located in the side face of the housing 111, and the air outlet 113 located in a part of the front face of the housing 111 above the air inlet 112. At least one up/down air flow deflection louver 120 and at least one left/right air flow deflection louver 121 are disposed at the air outlet 113.

The left/right air flow deflection louver 121 has a cantilevered configuration with a rotational axis located downstream with respect to the flow of blowing air (see FIG. 23). The left/right air flow deflection louver 121 has a trapezoidal shape such that the edge of the left/right air flow deflection louver 121 located upstream with respect to the flow of blowing air is obliquely cut out at the lower end to define a cutout 124*c* that extends linearly. The portion of the left/right air flow deflection louver 121 where the cutout 124*c* is present does not overlap an adjacent left/right air flow deflection louver 121 even when the left/right air flow deflection louver 121 is in its closed state. This ensures that an air passage is established in the air outlet 113 even when the left/right air flow deflection louver 121 is in its closed state.

The up/down air flow deflection louver 120 has a shape such that its edge located downstream with respect to the flow of blowing air is obliquely cut out respectively at both left and right ends to define cutouts 124*d* and 124*e* that extend linearly (see FIG. 25). The portion of the up/down air flow deflection louver 120 where the cutouts 124*d* and 124*e* are present does not overlap an adjacent up/down air flow deflection louver 120 even when the up/down air flow deflection louver 120 is in its closed state. This ensures that an air passage is established in the air outlet 113 even when the up/down air flow deflection louver 120 is in its closed state.

The shutter 125 (shutter panel) is disposed at the air outlet 113 to open and close the air outlet 113. The shutter 125 is controlled by the controller 30 to operate between an open state (see FIG. 22) and a closed state (see FIG. 24). In the present example, when the shutter 125 becomes closed, the air outlet 113 is blocked by the shutter 125. The shutter 125 becomes open when operation of the indoor unit 1 is started, and becomes closed when operation of the indoor unit 1 is stopped.

Figure 26:
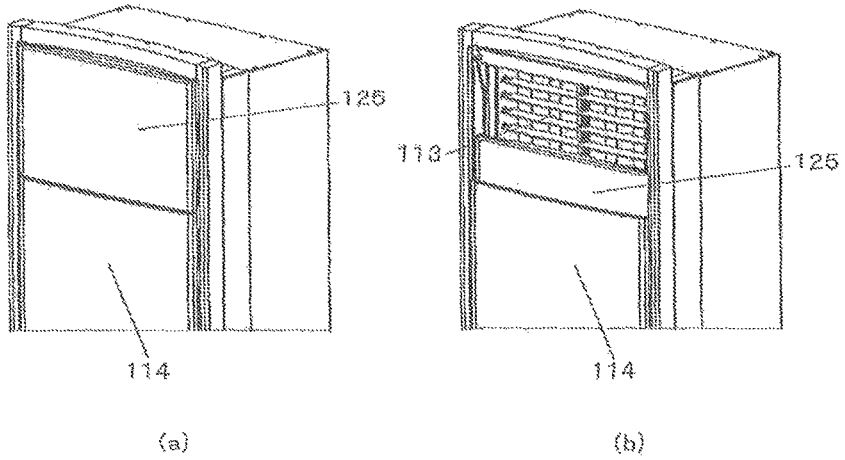
FIG. 26 is a perspective view of the indoor unit 1 of the refrigeration cycle apparatus according to Embodiment 2 of the present invention, illustrating an example of the configuration of the shutter 125 together with its closed and semi-open states.

FIG. 26 is a perspective view of the shutter 125, illustrating an example of the configuration of the shutter 125 together with its closed state (FIG. 26 (*a*)) and its semi-open state (FIG. 26(*b*)), which is an intermediate state between the closed state and an open state (for example, a full open state). As illustrated in FIG. 26, when the shutter 125 changes from a closed state to an open state, the shutter 125 moves downward, causing the shutter 125 to be stored behind a front panel 114 (that is, on the inner side of the housing) located below the air outlet 113. This causes the air outlet 113 to be exposed to the front side, thus creating an air passage through the air outlet 113.

Figure 27:
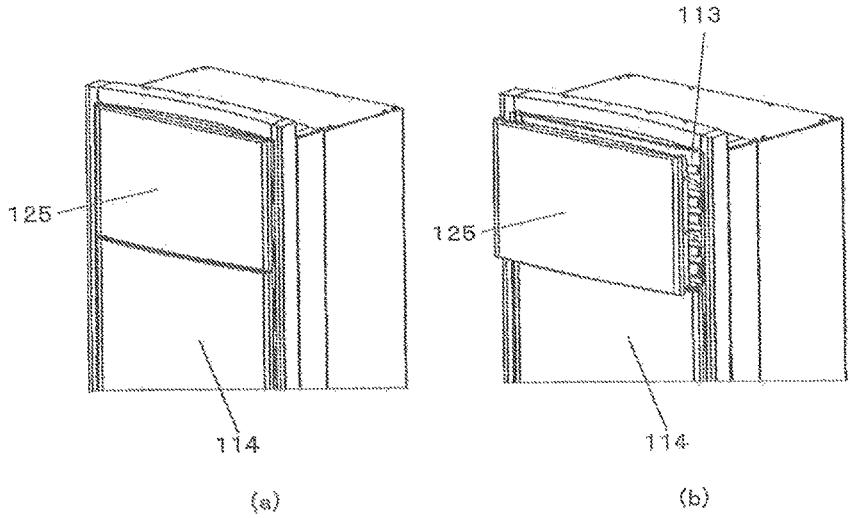
FIG. 27 is a perspective view of the indoor unit 1 of the refrigeration cycle apparatus according to Embodiment 2 of the present invention, illustrating another example of the configuration of the shutter 125 together with its closed and open states.

FIG. 27 is a perspective view of the shutter 125, illustrating another example of the configuration of the shutter 125 together with its closed state (FIG. 27(*a*)) and its open state (FIG. 27(*b*)). As illustrated in FIG. 27, when the shutter 125 changes from a closed state to an open state, the shutter 125 undergoes parallel displacement in the frontward direction. As a result, an air passage through the air outlet 113 is created around the shutter 125. This configuration ensures that the air outlet 113 is not visible from the front of the indoor unit 1 even when the shutter 125 is open, thus allowing for enhanced design of the indoor unit 1.

Figure 28:
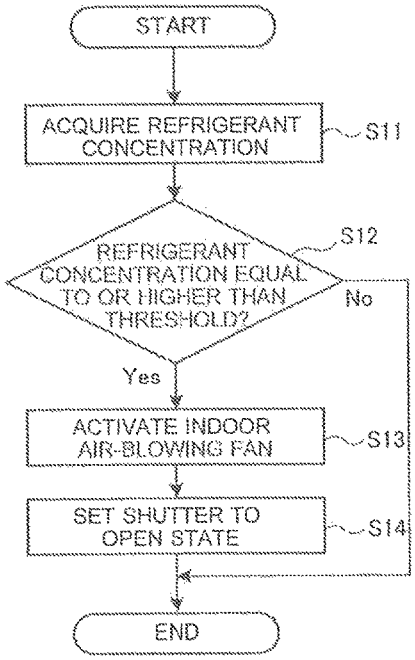
FIG. 28 is a flowchart illustrating an example of a refrigerant leak detection process executed by the controller 30 in the refrigeration cycle apparatus according to Embodiment 2 of the present invention.

FIG. 28 is a flowchart illustrating an example of a refrigerant leak detection process executed by the controller 30. This refrigerant leak detection process is repeatedly executed at predetermined time intervals either on a constant basis, including when the air-conditioning apparatus is operating and when the air-conditioning apparatus is stopped, or only when the air-conditioning apparatus is stopped. Steps S11 to S13 are the same as steps S1 to S3 illustrated in FIG. 7.

As illustrated in FIG. 28, if it is determined that the concentration of refrigerant is equal to or higher than a threshold, step S14 is executed in addition to S13 that is the same as S3 illustrated in FIG. 7. At step S14, the shutter 125 is set to an open state (for example, a full open state or semi-open state). If the shutter 125 is already in its open state, that state is maintained as it is. This ensures that an air passage is established in the air outlet 113 at least when leakage of the refrigerant is detected. The order of step S13 and step S14 may be interchanged.

Figure 29:
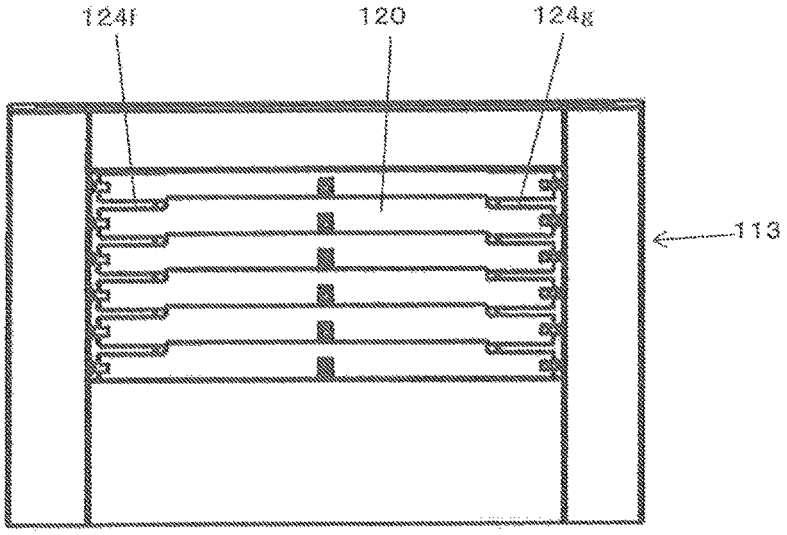
FIG. 29 is a front view of the indoor unit 1 of the refrigeration cycle apparatus according to Embodiment 2 of the present invention, illustrating another example of the configuration in the vicinity of the air outlet 113.

FIG. 29 is a front view of the indoor unit 1 illustrating another example of the configuration in the vicinity of the air outlet 113. FIG. 29 depicts a closed state with the up/down air flow deflection louver 120 rotated upward to the maximum angle within a movable range. As illustrated in FIG. 29, six up/down air flow deflection louvers 120 are disposed at the air outlet 113. The up/down air flow deflection louver 120 has a shape such that its edge located downstream with respect to the flow of blowing air is cut out respectively at both left and right ends to define rectangular cutouts 124*f* and 124*g*. The portion of the up/down air flow deflection louver 120 where the cutouts 124*f* and 124*g* are present does not overlap an adjacent up/down air flow deflection louver 120 even when the up/down air flow deflection louver 120 is in its closed state. This ensures that an air passage is established in the air outlet 113 even when the up/down air flow deflection louver 120 is in its closed state.

Figure 30:
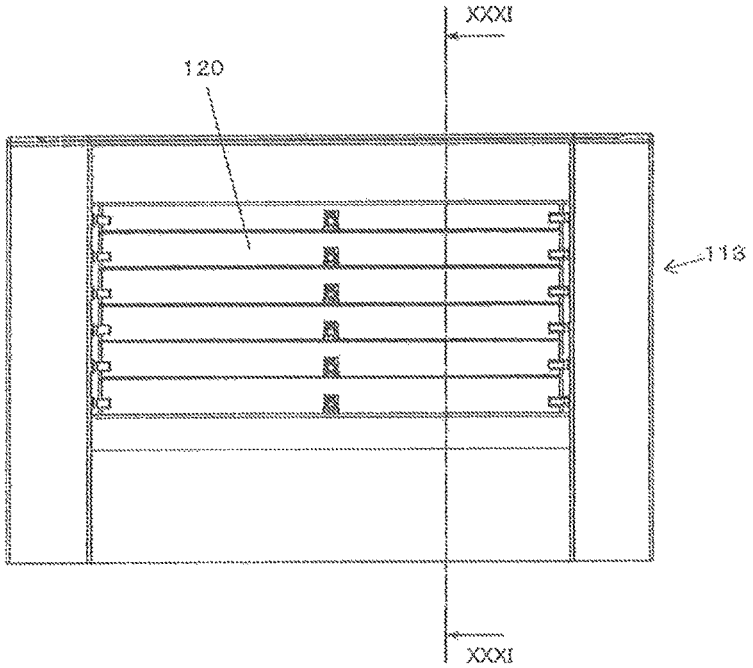
FIG. 30 is a front view of the indoor unit 1 of the refrigeration cycle apparatus according to Embodiment 2 of the present invention, illustrating still another example of the configuration in the vicinity of the air outlet 113.
Figure 31:
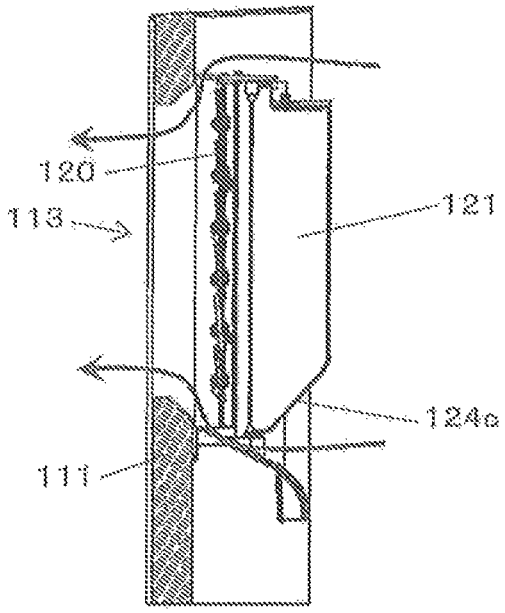
FIG. 31 is a sectional view taken along XXXI-XXXI in FIG. 30.

FIG. 30 is a front view of the indoor unit 1 illustrating still another example of the configuration in the vicinity of the air outlet 113. FIG. 31 is a sectional view taken along XXXI-XXXI in FIG. 30. FIGS. 30 and 31 depict a closed state with the up/down air flow deflection louver 120 rotated upward to the maximum angle within a movable range (in the manner of a louver). The left-hand side in FIG. 31 indicates the front side of the indoor unit 1. As illustrated in FIGS. 30 and 31, six up/down air flow deflection louvers 120 are disposed at the air outlet 113. The up/down air flow deflection louver 120 is located at the back side relative to the open end of the air outlet 113. Thus, in at least one of the areas above, below, and to the side of the up/down air flow deflection louver 120, an air passage that goes around the up/down air flow deflection louver 120 is created as indicated by the thick arrows in FIG. 31. This ensures that an air passage is established in the air outlet 113 even when the up/down air flow deflection louver 120 is in its closed state.

As described above, as with Embodiment 1, Embodiment 2 ensures that an air passage is established in the air outlet 113 at least when leakage of refrigerant is detected (for example, at all times). Accordingly, rotating the indoor air-blowing fan 7*f* at this time allows leaked refrigerant to be blown out from the air outlet 113 together with a sufficient amount of air. This enables effective dispersion of the leaked refrigerant. This makes it possible to reduce the occurrence of locally increased refrigerant concentrations in the indoor space in the event of a refrigerant leak.

Embodiment 3

Figure 32:
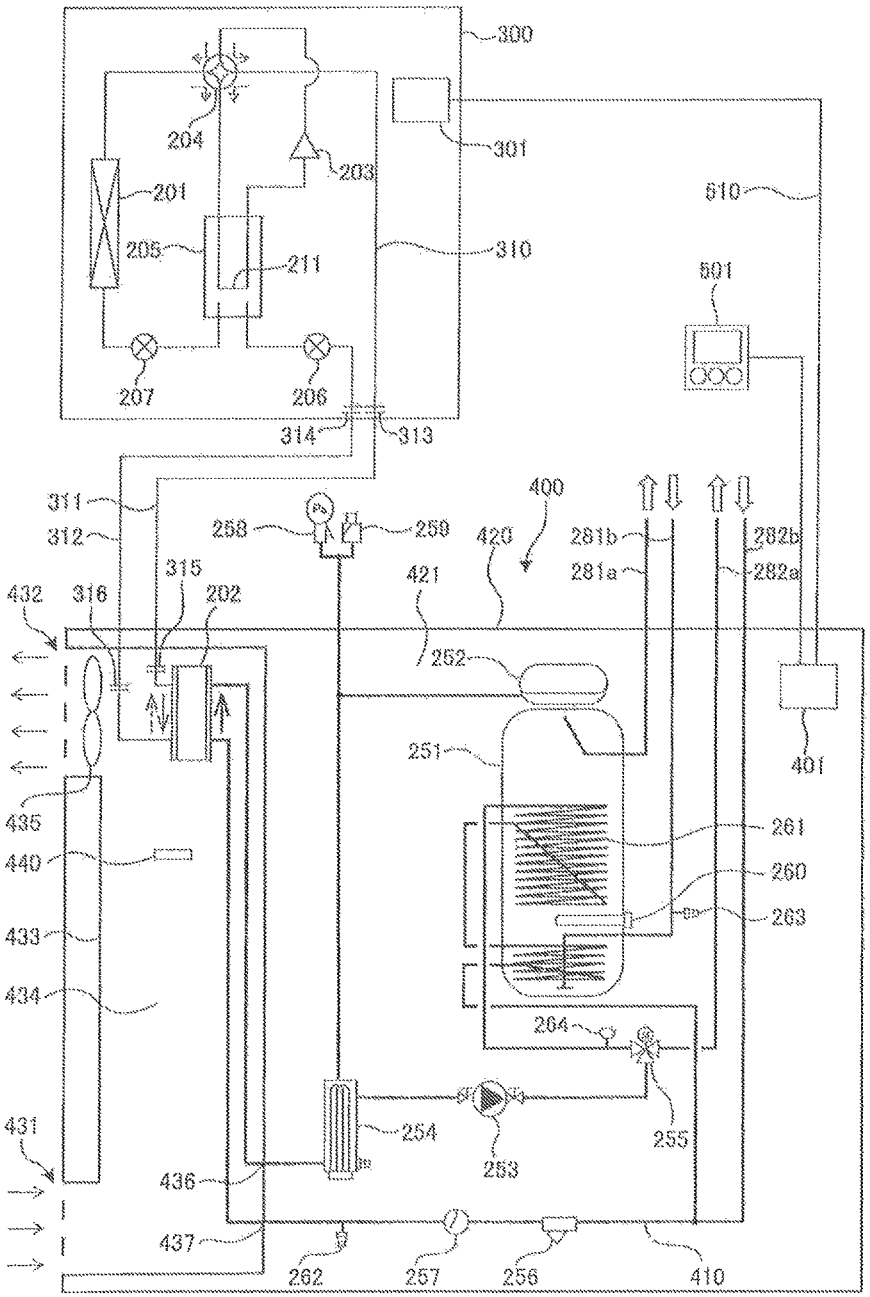
FIG. 32 is a refrigerant circuit diagram illustrating the general configuration of a refrigeration cycle apparatus according to Embodiment 3 of the present invention.

A refrigeration cycle apparatus according to Embodiment 3 of the present invention will be described. FIG. 32 is a refrigerant circuit diagram illustrating the general configuration of a refrigeration cycle apparatus according to Embodiment 3 of the present invention. Embodiment 3 describes a heat pump water heater as an example of a refrigeration cycle apparatus.

As illustrated in FIG. 32, the heat pump water heater includes a refrigerant circuit 310 through which refrigerant is circulated and which constitutes a refrigeration cycle, and a water circuit 410 through which water (an example of a heat medium) is routed (an example of a heat medium circuit). First, the refrigerant circuit 310 will be described. The refrigerant circuit 310 includes the following components connected in a loop via refrigerant pipes in the order stated below: a compressor 203, a refrigerant flow switching device 204, a load-side heat exchanger 202, a first pressure reducing device 206, an intermediate-pressure receiver 205, a second pressure reducing device 207, and a heat source-side heat exchanger 201. The heat pump water heater is capable of normal operation (heating/hot water supply operation) in which water flowing through the water circuit 410 is heated, and defrost operation in which refrigerant is caused to flow in a direction opposite to that in normal operation to defrost the heat source-side heat exchanger 201. The heat pump water heater has a load unit 400 (indoor unit) that is placed indoors, and a heat source unit 300 (outdoor unit) that is placed, for example, outdoors. The load unit 400 is placed in, for example, a kitchen, a bathroom, or a laundry room, or in a storage space inside a building, such as a storage room.

Examples of refrigerants circulated through the refrigerant circuit 310 include flammable refrigerants such as those described above, and non-flammable refrigerants.

The compressor 203 is a piece of fluid machinery that compresses a low-pressure refrigerant sucked into the compressor 203, and discharges the compressed refrigerant as a high-pressure refrigerant. The compressor 203 in the present example includes an inverter device or other devices. The driving frequency of the compressor 203 can be varied as desired to vary the capacity (the amount of refrigerant delivered per unit time) of the compressor 203.

The refrigerant flow switching device 204 switches the directions of refrigerant flow within the refrigerant circuit 310 between when in normal operation and when in defrost operation. The refrigerant flow switching device 204 used is, for example, a four-way valve.

The load-side heat exchanger 202 is a refrigerant-water heat exchanger in which heat is exchanged between the refrigerant flowing through the refrigerant circuit 310 and the water flowing through the water circuit 410. The load-side heat exchanger 202 used is, for example, a plate-type heat exchanger (brazed plate-type heat exchanger) having a plurality of components jointed together by brazing. In normal operation, the load-side heat exchanger 202 acts as a condenser (radiator) that heats water, and in defrost operation, the load-side heat exchanger 202 acts as an evaporator (heat absorber).

The first pressure reducing device 206 and the second pressure reducing device 207 each regulate the flow rate of refrigerant to regulate (reduce) the pressure of refrigerant that enters the load-side heat exchanger 202 or the heat source-side heat exchanger 201. The intermediate-pressure receiver 205 is located between the first pressure reducing device 206 and the second pressure reducing device 207 in the refrigerant circuit 310 to store surplus refrigerant. A suction pipe 211 connected to the suction side of the compressor 203 passes through the interior of the intermediate-pressure receiver 205. In the intermediate-pressure receiver 205, heat is exchanged between the refrigerant flowing through the suction pipe 211, and the refrigerant inside the intermediate-pressure receiver 205. Thus, the intermediate-pressure receiver 205 acts as an internal heat exchanger for the refrigerant circuit 310. Examples of a device that can be used as each of the first pressure reducing device 206 and the second pressure reducing device 207 include an electronic expansion valve whose opening degree can be variably controlled by a controller 301 described later.

The heat source-side heat exchanger 201 is a refrigerant-air heat exchanger in which heat is exchanged between the refrigerant flowing through the refrigerant circuit 310, and the air (outside air) sent by the outdoor air-blowing fan (not illustrated). The heat source-side heat exchanger 201 acts as an evaporator (heat absorber) in normal operation, and acts as a condenser (radiator) in defrost operation.

The compressor 203, the refrigerant flow switching device 204, the first pressure reducing device 206, the intermediate-pressure receiver 205, the second pressure reducing device 207, and the heat source-side heat exchanger 201 are accommodated in the heat source unit 300. The load-side heat exchanger 202 is accommodated in the load unit 400. The heat source unit 300 and the load unit 400 are connected by, for example, two extension pipes 311 and 312, which each constitute a part of a refrigerant pipe. The extension pipes 311 and 312, and the corresponding refrigerant pipes inside the heat source unit 300 are respectively connected via couplings 313 and 314 (for example, flare couplings). The extension pipes 311 and 312, and the corresponding refrigerant pipes inside the load unit 400 (for example, refrigerant pipes joined to the load-side heat exchanger 202 by brazing) are respectively connected via couplings 315 and 316 (for example, flare couplings).

The heat source unit 300 is provided with the controller 301 (an example of a controller) that mainly controls operation of the refrigerant circuit 310 (for example, the compressor 203, the refrigerant flow switching device 204, the first pressure reducing device 206, the second pressure reducing device 207, an outdoor air-blowing fan (not illustrated), and other components). The controller 301 has a microcomputer including components such as a CPU, a ROM, a RAM, and an I/O port. The controller 301 is capable of communicating data with a controller 401 and an operating unit 501 that will be described later, via a control line 510.

Next, an example of operation of the refrigerant circuit 310 will be described. In FIG. 32, the direction in which refrigerant flows through the refrigerant circuit 310 in normal operation is indicated by solid arrows. In normal operation, the refrigerant circuit 310 is configured such that the flow path of refrigerant is switched by the refrigerant flow switching device 204 as indicated by the solid lines, causing a high-temperature, high-pressure refrigerant to flow to the load-side heat exchanger 202.

The high-temperature, high-pressure gas refrigerant discharged from the compressor 203 enters the flow path of refrigerant in the load-side heat exchanger 202 via the refrigerant flow switching device 204 and the extension pipe 311. In normal operation, the load-side heat exchanger 202 acts as a condenser. That is, in the load-side heat exchanger 202, heat is exchanged between the refrigerant flowing through the refrigerant flow path, and the water flowing through the water flow path in the load-side heat exchanger 202, and the condensation heat of the refrigerant is rejected to the water. This causes the refrigerant entering the load-side heat exchanger 202 to condense into a high-pressure liquid refrigerant. The water flowing through the water flow path in the load-side heat exchanger 202 is heated by the heat rejected by the refrigerant.

The high-pressure liquid refrigerant condensed by the load-side heat exchanger 202 flows via the extension pipe 312 into the first pressure reducing device 206, where the refrigerant undergoes a slight decrease in pressure and turns into a two-phase refrigerant. The two-phase refrigerant enters the intermediate-pressure receiver 205, where the refrigerant is cooled into a liquid refrigerant through heat exchange with a low-pressure gas refrigerant flowing through the suction pipe 211. The liquid refrigerant enters the second pressure reducing device 207 where its pressure is reduced, causing the refrigerant to turn into a low-pressure, two-phase refrigerant. The low-pressure, two-phase refrigerant enters the heat source-side heat exchanger 201. In normal operation, the heat source-side heat exchanger 201 acts as an evaporator. That is, in the heat source-side heat exchanger 201, heat is exchanged between the refrigerant being circulated in the heat source-side heat exchanger 201, and the air (outside air) being sent by the outdoor air-blowing fan, and the evaporation heat of the refrigerant is removed by the air being sent. This causes the refrigerant entering the heat source-side heat exchanger 201 to evaporate into a low-pressure gas refrigerant. The low-pressure gas refrigerant enters the suction pipe 211 via the refrigerant flow switching device 204. Upon entering the suction pipe 211, the low-pressure gas refrigerant is heated through heat exchange with the refrigerant inside the intermediate-pressure receiver 205, and then sucked into the compressor 203. The refrigerant sucked into the compressor 203 is compressed into a high-temperature, high-pressure gas refrigerant. The above cycle is repeated in normal operation.

Next, an example of operation in defrost operation will be described. In FIG. 32, the direction in which refrigerant flows through the refrigerant circuit 310 in defrost operation is indicated by broken arrows. In defrost operation, the refrigerant circuit 310 is configured such that the flow path of refrigerant is switched by the refrigerant flow switching device 204 as indicated by the broken lines, causing a high-temperature, high-pressure refrigerant to flow to the heat source-side heat exchanger 201.

The high-temperature, high-pressure gas refrigerant discharged from the compressor 203 enters the heat source-side heat exchanger 201 via the refrigerant flow switching device 204. In defrost operation, the heat source-side heat exchanger 201 acts as a condenser. That is, in the heat source-side heat exchanger 201, heat is exchanged between the refrigerant being circulated in the heat source-side heat exchanger 201, and the frost depositing on the surface of the heat source-side heat exchanger 201. As a result, the frost depositing on the surface of the heat source-side heat exchanger 201 is heated to melt by the condensation heat of the refrigerant.

Next, the water circuit 410 will be described. The water circuit 410 includes, for example, the following components connected via a water pipe: a hot water storage tank 251, the load-side heat exchanger 202, a pump 253, a booster heater 254, a three-way valve 255, a strainer 256, a flow switch 257, a pressure relief valve 258, and an air purge valve 259. A drainage port 262 for draining the water inside the water circuit 410 is located at a point along the pipe constituting the water circuit 410.

The hot water storage tank 251 is a device that stores water inside. The hot water storage tank 251 has a built-in coil 261 connected to the water circuit 410. The coil 261 causes heat to be exchanged between the water (warm water) being circulated in the water circuit 410 and the water stored in the hot water storage tank 251, thus heating the water stored in the hot water storage tank 251. The hot water storage tank 251 also has a built-in submerged heater 260. The submerged heater 260 is a heating unit for further heating the water stored in the hot water storage tank 251.

The water in the hot water storage tank 251 flows to, for example, a sanitary circuit-side pipe 281*a* (supply pipe) connected to a shower or other devices. A sanitary circuit-side pipe 281*b* (return pipe) also includes a drainage port 263. The hot water storage tank 251 is covered with a heat insulator (not illustrated) to prevent the water stored in the hot water storage tank 251 from being cooling by the outside air. Examples of the heat insulator used include felt, Thinsulate (registered trademark), and vacuum insulation panel (VIP).

The pump 253 is a device that applies pressure to the water in the water circuit 410 to circulate the water within the water circuit 410. The booster heater 254 is a device that further heats the water in the water circuit 410 in situations such as when the heat source unit 300 does not have a sufficient heating capacity. The three-way valve 255 is a device used to split the water in the water circuit 410 into separate streams. For example, the three-way valve 255 switches the flow of water in the water circuit 410 such that the water is either routed toward the hot water storage tank 251 or routed toward a heating circuit-side pipe 282*a* (supply pipe) that is connected with a heating unit, such as an external radiator or a floor heating unit. The heating circuit-side pipe 282*a* (supply pipe) and a heating circuit-side pipe 282*b* (return pipe) are pipes that cause water to circulate between the water circuit 410 and the heating unit. The strainer 256 is a device that removes scale (deposits) that forms inside the water circuit 410. The flow switch 257 is a device that detects whether the water circulating in the water circuit 410 has a flow rate equal to or greater than a predetermined value.

An expansion tank 252 is a device used to keep, within a predetermined range, the pressure that varies with variations in the volume of the water in the water circuit 410 that result from heating or other processes. The pressure relief valve 258 is a protection device. When the pressure in the water circuit 410 rises above a pressure control range set for the expansion tank 252, the water in the water circuit 410 is released to the outside by the pressure relief valve 258. The air purge valve 259 is a device that releases the air generated in or mixed into the water circuit 410 to the outside to prevent idle running (air entrainment) of the pump 253. A manual air purge valve 264 is a manual valve for purging air from the water circuit 410. The manual air purge valve 264 is used to purge, for example, the air mixed into the water circuit 410 when water is filled during installation work.

The water circuit 410 is accommodated in a housing 420 of the load unit 400. At least a portion (for example, the hot water storage tank 251, the pump 253, the booster heater 254, and water pipes or other components connected to those components) of the water circuit 410 accommodated in the housing 420 is disposed in a water circuit chamber 421 (an example of a heat medium circuit chamber) located inside the housing 420. At least the load-side heat exchanger 202 (for example, only the load-side heat exchanger 202 and a water pipe connected to the load-side heat exchanger 202) of the water circuit 410 is disposed in an air flow path 434 described later. That is, the water circuit 410 lies across both the water circuit chamber 421 and the air flow path 434 inside the housing 420.

The load unit 400 is provided with the controller 401 (an example of a controller) that controls the water circuit 410 (for example, its components such as the pump 253, the booster heater 254, and the three-way valve 255), an air-blowing fan 435 described later, and other components. The controller 401 has a microcomputer including components such as a CPU, a ROM, a RAM, and an I/O port. The controller 401 is capable of communicating data with the controller 301 and the operating unit 501 that will be described later.

The operating unit 501 allows the user to operate the heat pump water heater or make various settings for the heat pump water heater. The operating unit 501 in the present example includes a display device to enable display of various information such as the state of the heat pump water heater. The operating unit 501 is disposed, for example, on the front face of the housing 420 of the load unit 400 at a height that allows the operating unit 501 to be operated by the user with a hand (for example, at a height of about 1.0 m to 1.5 m above the floor surface) (see FIG. 33).

Figure 33:
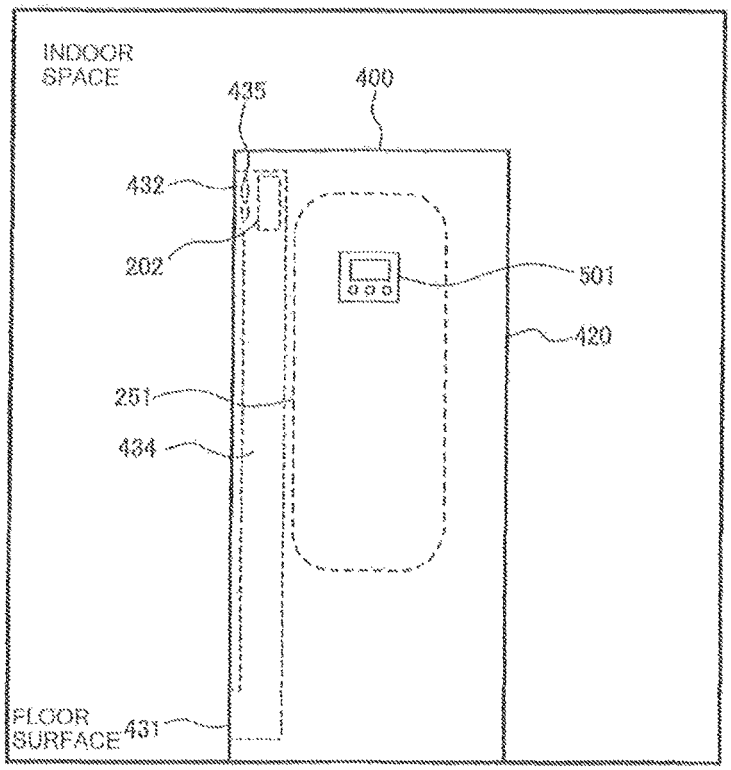
FIG. 33 is a front view of a load unit 400 of the refrigeration cycle apparatus according to Embodiment 3 of the present invention.

The structural features of the load unit 400 will be described with reference to FIG. 33 in addition to FIG. 32. FIG. 33 is a front view of the load unit 400. FIG. 33 also depicts an example of how the load unit 400 is placed indoors. As illustrated in FIGS. 32 and 33, the load unit 400 in the present example is of a floor-standing type that has the hot water storage tank 251 built in the load unit 400 and is placed on the indoor floor surface. The load unit 400 includes the housing 420 with a vertically elongated rectangular parallelepiped shape. The load unit 400 is installed such that, for example, a predetermined gap is present between the back surface of the housing 420 and the indoor wall surface. The housing 420 is made of, for example, metal.

The housing 420 is provided with an air inlet 431 through which indoor air is sucked in, and an air outlet 432 through which the air sucked in through the air inlet 431 is blown indoors. The air inlet 431 is located in a lower part of the side surface (the left side surface in the present example) of the housing 420. The air inlet 431 in the present example is located at a position below the operating unit 501 and near the indoor floor surface. The air outlet 432 is located in an upper part of the side surface (the left side surface in the present example) of the housing 420, that is, at a position above the air inlet 431. The air outlet 432 in the present example is located at a position above the operating unit 501 and near the top surface of the housing 420. The air outlet 432 is not provided with a device that opens or closes the air outlet 432. An air passage that allows air to pass through the air outlet 432 is thus established in the air outlet 432 at all times.

The air inlet 431 may be located in any one of the front surface, right side surface, and back surface of the housing 420 as long as the air inlet 431 is located in a lower part of the housing 420. The air outlet 432 may be located in any one of the top surface, front surface, right side surface, and back surface of the housing 420 as long as the air outlet 432 is located in an upper part of the housing 420.

Within the housing 420, the air inlet 431 and the air outlet 432 are connected by a duct 433 that extends generally vertically. The duct 433 is made of, for example, metal. The space inside the duct 433 defines the air flow path 434 through which air flows between the air inlet 431 and the air outlet 432. The air flow path 434 is separated from the water circuit chamber 421 by the duct 433. Since at least a part of the water circuit 410 is disposed in the water circuit chamber 421, and the load-side heat exchanger 202 is disposed in the air flow path 434, the duct 433 is provided with penetration parts 436 and 437 through which water pipes of the water circuit 410 penetrate. The air flow path 434 contains a small number of components in comparison to the water circuit chamber 421, allowing the air flow path 434 to be simplified in shape and reduced in volume.

The duct 433 provides, for example, hermetic separation between the air flow path 434 and the water circuit chamber 421 inside the housing 420. As a result, the entry and exit of gas between the air flow path 434 and the water circuit chamber 421 are prevented by the duct 433. The hermeticity of the duct 433 is provided also in the penetration parts 436 and 437. It is to be noted, however, that the air flow path 434 communicates with the space outside of the housing 420 via the air inlet 431 and the air outlet 432, and the water circuit chamber 421 is not necessarily hermetically sealed from the space outside of the housing 420. Therefore, the air flow path 434 and the water circuit chamber 421 are not necessarily hermetically separated from each other with respect to the space outside of the housing 420.

Not only the load-side heat exchanger 202 but also the couplings 315 and 316, which respectively connect the load-side heat exchanger 202 with the extension pipes 311 and 312, are disposed in the air flow path 434. In the present example, most (for example, all) of the components of the refrigerant circuit 310 accommodated in the load unit 400 are disposed in the air flow path 434. Thus, the air flow path 434 also functions as a refrigerant circuit chamber inside the housing 420 of the load unit 400. The load-side heat exchanger 202 and the couplings 315 and 316 are disposed in an upper part of the air flow path 434 (for example, above the midpoint between the upper and lower ends of the air flow path 434 (in the present example, at a position closer to the air outlet 432 than to the above-mentioned midpoint)).

The air-blowing fan 435 is disposed in the air flow path 434 to create, in the air flow path 434, a flow of air that travels toward the air outlet 432 from the air inlet 431. Examples of the air-blowing fan 435 used include a cross-flow fan, a turbo fan, a sirocco fan, and a propeller fan. The air-blowing fan 435 in the present example is placed facing the air outlet 432, for example. Operation of the air-blowing fan 435 is controlled by, for example, the controller 401.

A refrigerant detection unit 440 that detects a refrigerant leak is disposed in an area of the air flow path 434 below the load-side heat exchanger 202. The refrigerant detection unit 440 in the present example is located below the couplings 315 and 316. The refrigerant detection unit 440 detects, for example, the concentration of refrigerant in the air around the refrigerant detection unit 440, and outputs the resulting detection signal to the controller 401. The controller 401 determines whether there is a refrigerant leak based on the detection signal from the refrigerant detection unit 440. As the refrigerant detection unit 440, a gas sensor (for example, a semiconductor gas sensor or a hot-wire type semiconductor gas sensor) is used.

Figure 34:
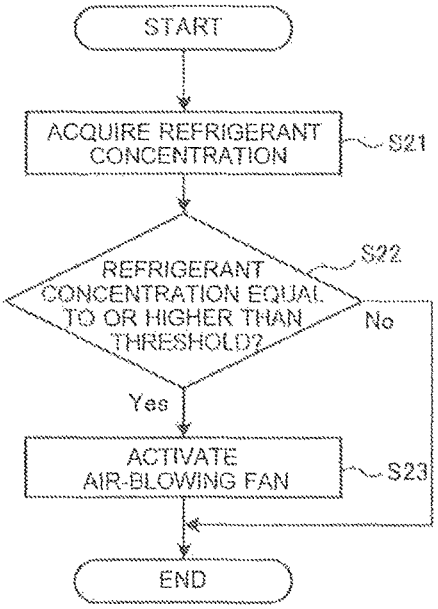
FIG. 34 is a flowchart illustrating an example of a refrigerant leak detection process executed by a controller 401 in the refrigeration cycle apparatus according to Embodiment 3 of the present invention.

FIG. 34 is a flowchart illustrating an example of a refrigerant leak detection process executed by the controller 401. For example, this refrigerant leak detection process is repeatedly executed at predetermined time intervals on a constant basis, including when the heat pump water heater is operating and when the heat pump water heater is stopped.

At step S21 in FIG. 34, the controller 401 acquires, based on a detection signal from the refrigerant detection unit 440, information on the concentration of refrigerant around the refrigerant detection unit 440.

Next, it is determined at step S22 whether the concentration of refrigerant around the refrigerant detection unit 440 is equal to or higher than a preset threshold. If it is determined that the refrigerant concentration is equal to or higher than the threshold, the process proceeds to step S23. If it is determined that the refrigerant concentration is less than the threshold, the process is ended.

At step S23, the operation of the air-blowing fan 435 is started. If the air-blowing fan 435 is already operating, the operation is continued as it is. This creates, in the air flow path 434, a flow of air that travels from the air inlet 431 toward the air outlet 432. At step S23, components such as a display unit and a voice output unit provided in the operating unit 501 may be used to inform the user that leakage of refrigerant has occurred. Once started, the operation of the air-blowing fan 435 is continued until, for example, the time elapsed since the concentration of refrigerant has become lower than the threshold reaches a preset time, or until the operation is stopped by a service person operating the operating unit 501 or other devices.

As described above, as with Embodiments 1 and 2, Embodiment 3 ensures that an air passage is established in the air outlet 432 at least when leakage of refrigerant is detected (for example, at all times). Accordingly, rotating the air-blowing fan 435 at this time allows leaked refrigerant to be blown out from the air outlet 432 together with a sufficient amount of air. This enables effective dispersion of the leaked refrigerant. This makes it possible to reduce the occurrence of locally increased refrigerant concentrations in the indoor space in the event of a refrigerant leak.

As described above, the refrigeration cycle apparatus according to each of Embodiments 1 to 3 mentioned above is a refrigeration cycle apparatus including the refrigeration cycle 40 (or the refrigerant circuit 310) through which refrigerant is circulated, the indoor unit 1 (or the load unit 400) that accommodates at least the load-side heat exchanger 7 (or the load-side heat exchanger 202) of the refrigeration cycle 40 and is placed indoors, and the controller 30 (or the controller 401) that controls the indoor unit 1. The indoor unit 1 includes the indoor air-blowing fan 7*f* (or the air-blowing fan 435), the air inlet 112 (or the air inlet 431) through which indoor air is sucked in, and the air outlet 113 (or the air outlet 432) through which the air sucked in from the air inlet 112 is blown indoors. The controller 30 activates the indoor air-blowing fan 7*f* when leakage of the refrigerant is detected. An air passage that allows air to pass through the air outlet 113 is established in the air outlet 113 at least when leakage of the refrigerant is detected. The air passage may be established in the air outlet 113 with detection of a refrigerant leak as a trigger, or may be established at all times irrespective of whether a refrigerant leak is detected.

In the refrigeration cycle apparatus according to each of the above-mentioned embodiments, the air outlet 113 is provided with the up/down air flow deflection louver 120 that adjusts the up/down direction of flow of air blown out from the air outlet 113, and an air passage is established in the air outlet 113 irrespective of how the up/down air flow deflection louver 120 is oriented within a movable range of the up/down air flow deflection louver 120.

In the refrigeration cycle apparatus according to each of the above-mentioned embodiments, the air outlet 113 is provided with the up/down air flow deflection louver 120 that adjusts the up/down direction of flow of air blown out from the air outlet 113, the up/down air flow deflection louver 120 is controlled by the controller 30 to operate between an open state and a closed state, the closed state being a state in which the air outlet 113 has a decreased opening area relative to the open state, and the controller 30 sets the up/down air flow deflection louver 120 to the open state when leakage of the refrigerant is detected.

In the refrigeration cycle apparatus according to each of the above-mentioned embodiments, the air outlet 113 is provided with the left/right air flow deflection louver 121 that adjusts the left/right direction of flow of air blown out from the air outlet 113, and an air passage is established in the air outlet 113 irrespective of how the left/right air flow deflection louver 121 is oriented within a movable range of the left/right air flow deflection louver 121.

In the refrigeration cycle apparatus according to each of the above-mentioned embodiments, the air outlet 113 is provided with the left/right air flow deflection louver 121 that adjusts the left/right direction of flow of air blown out from the air outlet 113, the left/right air flow deflection louver 121 is controlled by the controller 30 to operate between an open state and a closed state, the closed state being a state in which the air outlet 113 has a decreased opening area relative to the open state, and the controller 30 sets the left/right air flow deflection louver 121 to the open state when leakage of the refrigerant is detected.

In the refrigeration cycle apparatus according to each of the above-mentioned embodiments, the air outlet 113 is provided with the shutter 125 that is controlled to open and close by the controller 30, and the controller 30 causes the shutter 125 to open when leakage of the refrigerant is detected.

Although an air-conditioning apparatus and a heat pump water heater have been each described above with reference to the above-mentioned embodiments as an example of a refrigeration cycle apparatus, the present invention is also applicable to a refrigeration cycle apparatus other than an air-conditioning apparatus and a heat pump water heater.

The above-mentioned embodiments and modifications can be implemented in combination with each other.

REFERENCE SIGNS LIST

1 indoor unit 2 outdoor unit 3 compressor 4 refrigerant flow switching device 5 heat source-side heat exchanger 5*f* outdoor air-blowing fan 6 pressure reducing device 7 load-side heat exchanger 7*f* indoor air-blowing fan 9*a*, 9*b* indoor pipe 10*a*, 10*b* extension pipe 11 suction pipe 12 discharge pipe 13*a*, 13*b* extension-pipe connection valve 14*a*, 14*b*, 14*c* service port 15*a*, 15*b* coupling 20 partition plate 20*a* air passage opening 25 electrical component box 26 operating unit 30 controller 40 refrigeration cycle 81 air passage space

91 suction air temperature sensor 92 heat exchanger inlet temperature sensor 93 heat exchanger temperature sensor 99 refrigerant detection unit 107 impeller 108 fan casing 108*a* air outlet opening 108*b* air inlet opening 111 housing 112 air inlet 113 air outlet 114 front panel 114*a* first front panel 114*b* second front panel 114*c* third front panel 115*a* lower space 115*b* upper space 120, 120*a*, 120*b*, 120*c*, 120*d*, 120*e* up/down air flow deflection louver 121, 121*a*, 121*b*, 121*c*, 121*d*, 121*e*, 121*f* left/right air flow deflection louver 122 side wall 122*a* clearance part 123 rotational axis 124*a*, 124*b*, 124*c*, 124*d*, 124*e*, 124*f*, 124*g* cutout 125 shutter 130 recess 131 lid 201 heat source-side heat exchanger 202 load-side heat exchanger 203 compressor 204 refrigerant flow switching device 205 intermediate-pressure receiver 206 first pressure reducing device 207 second pressure reducing device 211 suction pipe 251 hot water storage tank 252 expansion tank 253 pump 254 booster heater 255 three-way valve 256 strainer 257 flow switch 258 pressure relief valve 259 air purge valve 260 submerged heater 261 coil 262, 263 drainage port 264 manual air purge valve 281*a*, 281*b* sanitary circuit-side pipe 282*a*, 282*b* heating circuit-side pipe 300 heat source unit 301 controller 310 refrigerant circuit 311, 312 extension pipe 313, 314, 315, 316 coupling 400 load unit 401 controller 410 water circuit 420 housing 421 water circuit chamber 431 air inlet 432 air outlet 433 duct 434 air flow path 435 air-blowing fan 436, 437 penetration part 440 refrigerant detection unit 501 operating unit 510 control line

The invention claimed is:

1. A refrigeration cycle apparatus comprising:

a refrigeration cycle through which refrigerant is circulated;

an indoor unit accommodating at least a load-side heat exchanger of the refrigeration cycle, the indoor unit being placed indoors; and a controller configured to control the indoor unit, wherein the indoor unit includes an air-blowing fan, an air inlet through which indoor air is sucked in, an air outlet through which the air sucked in from the air inlet is blown indoors, and airflow direction louvers configured to adjust direction of air blown out of the air outlet and configured to open and close the air outlet, the controller is configured to actuate all louvers of the indoor unit into a closed state, the air flow direction louvers in the closed state of the louvers are provided offset in an upstream position or a downstream position of an open end of the air outlet with respect to an airflow direction through the air outlet, an air passage that extends around all louvers of the indoor unit to permit exhaust of refrigerant while all louvers are in the closed state, and the controller is configured to activate the air-blowing fan in response to detecting a leakage of the refrigerant to exhaust the refrigerant through the air passage that extends around all louvers of the indoor unit.

2. A refrigeration cycle apparatus comprising:

a refrigeration cycle configured to circulate refrigerant;

an indoor unit accommodating at least a load-side heat exchanger of the refrigeration cycle and being placed indoors; and a controller configured to control the indoor unit, wherein the indoor unit includes an air-blowing fan, an air inlet through which indoor air is sucked in, an air outlet through which the air sucked in from the air inlet is blown indoors, airflow direction louvers provided to the air outlet and configured to adjust the direction of the air blown out of the air outlet, and a side wall forming an air passage of the air outlet, the airflow direction louvers are configured to open and close the air outlet, the controller is configured to actuate all louvers of the indoor unit into a closed state, the side wall includes, at a portion thereof including an open end of the air outlet, a clearance part protruding away from the airflow direction louvers, an air passage that extends around all louvers of the indoor unit to permit exhaust of refrigerant while all louvers are in the closed state, the air passage is formed between the clearance part and the air flow direction louver in the closed state, and the controller is configured to activate the air-blowing fan in response to detecting a leakage of the refrigerant to exhaust the refrigerant through the air passage that extends around all louvers of the indoor unit.

3. The refrigeration cycle apparatus of claim 1, wherein a notch portion is formed at a corner of the airflow direction louver.

4. The refrigeration cycle apparatus of claim 2, wherein a notch portion is formed at a corner of the airflow direction louver.

* * * * *